US006227530B1

(12) United States Patent
Namba et al.

(10) Patent No.: US 6,227,530 B1
(45) Date of Patent: May 8, 2001

(54) RESET METHOD AND RESET DEVICE IN UNUSUAL OPERATION OF SHEET PROCESSING DEVICE

(75) Inventors: Toyoaki Namba, Higashiosaka; Kyosuke Taka, Nara; Tsuyoshi Asahara, Yamanashi; Takashi Saito, Sakaigawa-mura; Kazuaki Sano, Yamanashi, all of (JP)

(73) Assignees: Sharp Kabushiki Kaisha, Osaka-Fu; Nisca Corporation, Yamanashi-ken, both of (JP)

( * ) Notice: Subject to any disclaimer, the term of this patent is extended or adjusted under 35 U.S.C. 154(b) by 0 days.

(21) Appl. No.: 09/103,027

(22) Filed: Jun. 23, 1998

(30) Foreign Application Priority Data

Jun. 23, 1997 (JP) ..... 9-165939

(51) Int. Cl.[7] ..... B65H 37/04

(52) U.S. Cl. ..... 270/58.09; 270/58.07; 399/18; 399/21; 399/79

(58) Field of Search ..... 270/58.07, 58.08, 270/58.09; 399/18, 19, 20, 21, 79, 403, 410

(56) References Cited

U.S. PATENT DOCUMENTS 4,054,380 * 10/1977 Donohue et al. ..... 399/21 X
4,173,408 * 11/1979 Stewart ..... 399/79
4,299,477 * 11/1981 Ward et al. ..... 399/19

FOREIGN PATENT DOCUMENTS 9-73251 3/1997 (JP) .
409073251 * 3/1997 (JP) .

* cited by examiner

*Primary Examiner*—Christopher P. Ellis
*Assistant Examiner*—Patrick Mackey
(74) *Attorney, Agent, or Firm*—Pitney, Hardin, Kipp & Szuch LLP

(57) ABSTRACT

A method and apparatus for resetting a sheet processing device is disclosed in which even if a trouble occurs, a sheet processing can be continued after resetting without wasting the previous processing. In a sheet processing device in which a set of sheets conveyed from an image forming device is discharged to a discharge tray after a predetermined processing process, the processing process is finely divided into plural function units and the function units are individually reset. In a memory device, a status flag indicating the condition of each module unit is assigned to each unit. The presence of a partially performed operation is confirmed by the status flag, and only the function unit having partially performed operation is reset to its initial condition.

8 Claims, 22 Drawing Sheets

RESET METHOD AND RESET DEVICE IN UNUSUAL OPERATION OF SHEET PROCESSING DEVICE

BACKGROUND OF THE INVENTION (i) Field of the Invention

The present invention relates to a sheet processing device for processing sheets with images formed thereon conveyed from a copying machine or another image forming device into a bunch and discharging the bunch onto a discharge tray, especially to a reset method and a reset device for the case where a fault occurs while a sheet processing device is operated.

(ii) Description of the Related Art

In a conventional art, when a jam or another fault occurs while sheets with images formed thereon by a copying machine or another image forming device are conveyed to a discharge tray, a factor of the fault is eliminated by removing jammed sheets or the like, then a device itself is reset, and an operation switch is pressed again, so that the subsequent sheet discharging or processing is performed. Additionally, by storing execution program conditions at the time of occurrence of abnormality, when program is executed again, a sheet processing is performed from the same condition as immediately before the abnormality occurs.

A sheet processing device is herein disclosed in which after sheets with images formed thereon by an image forming device are piled on a tray called a processing tray to form a bunch, the bunch is moved and conveyed from the processing tray to one or plural discharge trays from which a user can take the bunch. Therefore, when compared with a conventional method of discharging one sheet from the image forming device directly to the discharge tray, more processes are required such as a process of matching and bunching plural sheets, a process of stapling the bunched sheets, a process of sending the sheet bunch to the discharge tray and the like.

In this case, if a reset processing is performed in the same manner as in the conventional art after a fault occurs, the previous processing needs to be performed again, which disturbs a rapid sheet processing. Moreover, when the abnormal fault is eliminated during plural processes, in the conventional method, instructions are given to a user on a display in such a manner that the user goes back to each process to confirm the jamming of sheets or another abnormality, which increases burdens of the user in the reset processing and is laborious. Especially when in the stapling processing a stapler is stuck with staples or another defect occurs, to remove all the sheets in the previous processes requires much labor and time. Therefore, a more rapid resetting method which less burdens a user has been requested for.

SUMMARY OF THE INVENTION

Wherefore, an object of the invention is to provide a reset method and means in which even when a trouble occurs, a sheet processing can be performed continuously after resetting without wasting the previous processing.

To attain this and other objects, according to the invention, in a sheet processing device in which plural sheets conveyed from an image forming device are discharged to a discharge tray after a predetermined processing process, the processing process is finely divided into plural function units and each function unit is reset. In a memory means, a status flag or sensor indicating the condition of each function unit is assigned to the function unit. In the sheet processing device, the presence of a half performed operation is confirmed by the status flags assigned in the memory means, and only the function unit being operated is reset to its initial condition.

DETAILED DESCRIPTION OF THE PREFERRED EMBODIMENTS

An embodiment of an abnormality reset method or device in a sheet processing device of the invention will be described with reference to the accompanying drawings by clarifying an entire constitution of the sheet processing device. The device is constituted of a sheet post-processing device for stapling or processing otherwise plural sheets discharged from an image forming device to a processing tray (hereinafter referred to as the post-processing device) and an accumulation processing device for receiving a processed sheet bunch and discharging and accumulating the sheet bunch to a predetermined sheet discharge tray (hereinafter referred to as the accumulating tray).

Figure 1:
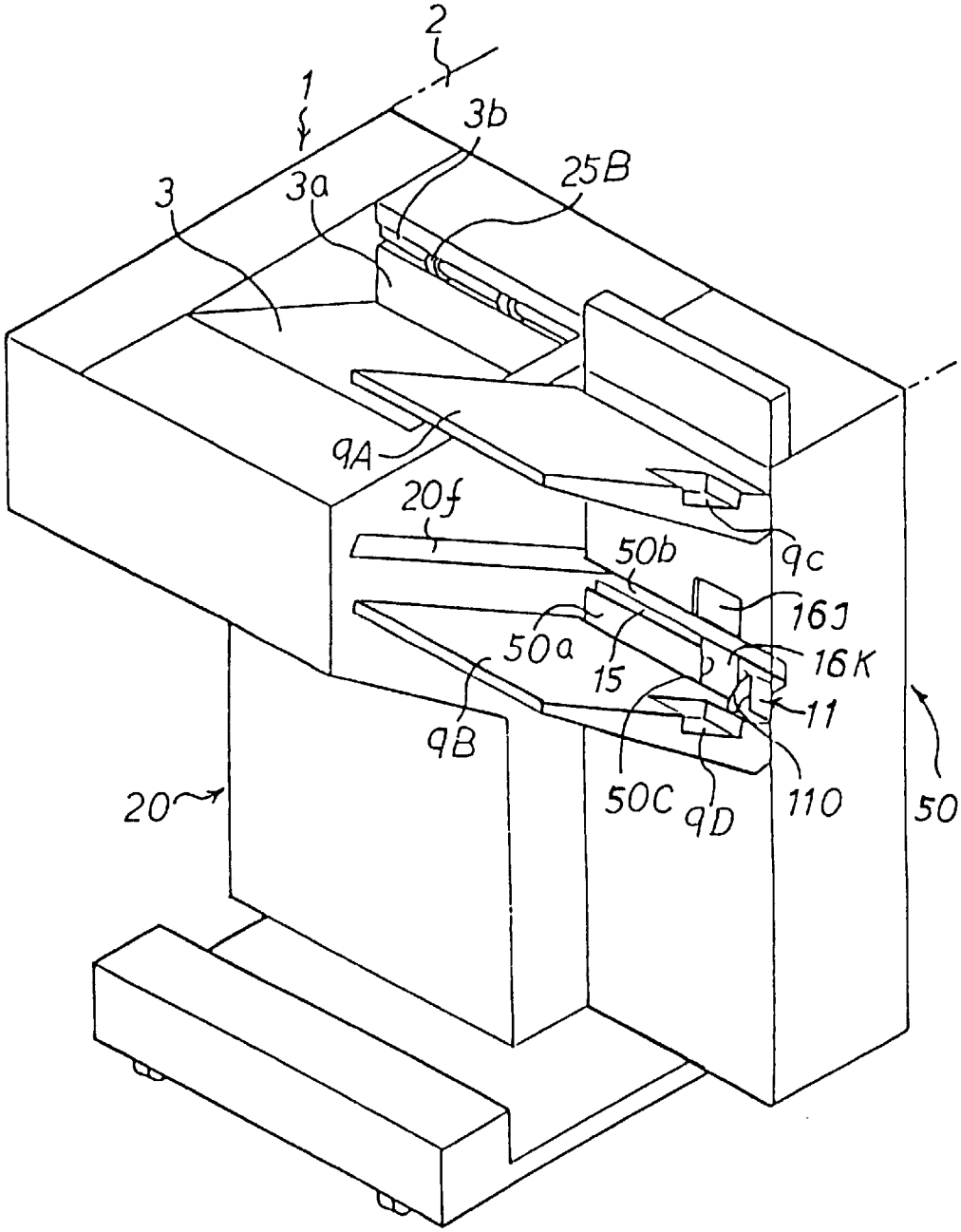
FIG. 1 is a perspective view showing a front appearance of a sheet processing device according to the invention.
Figure 2:
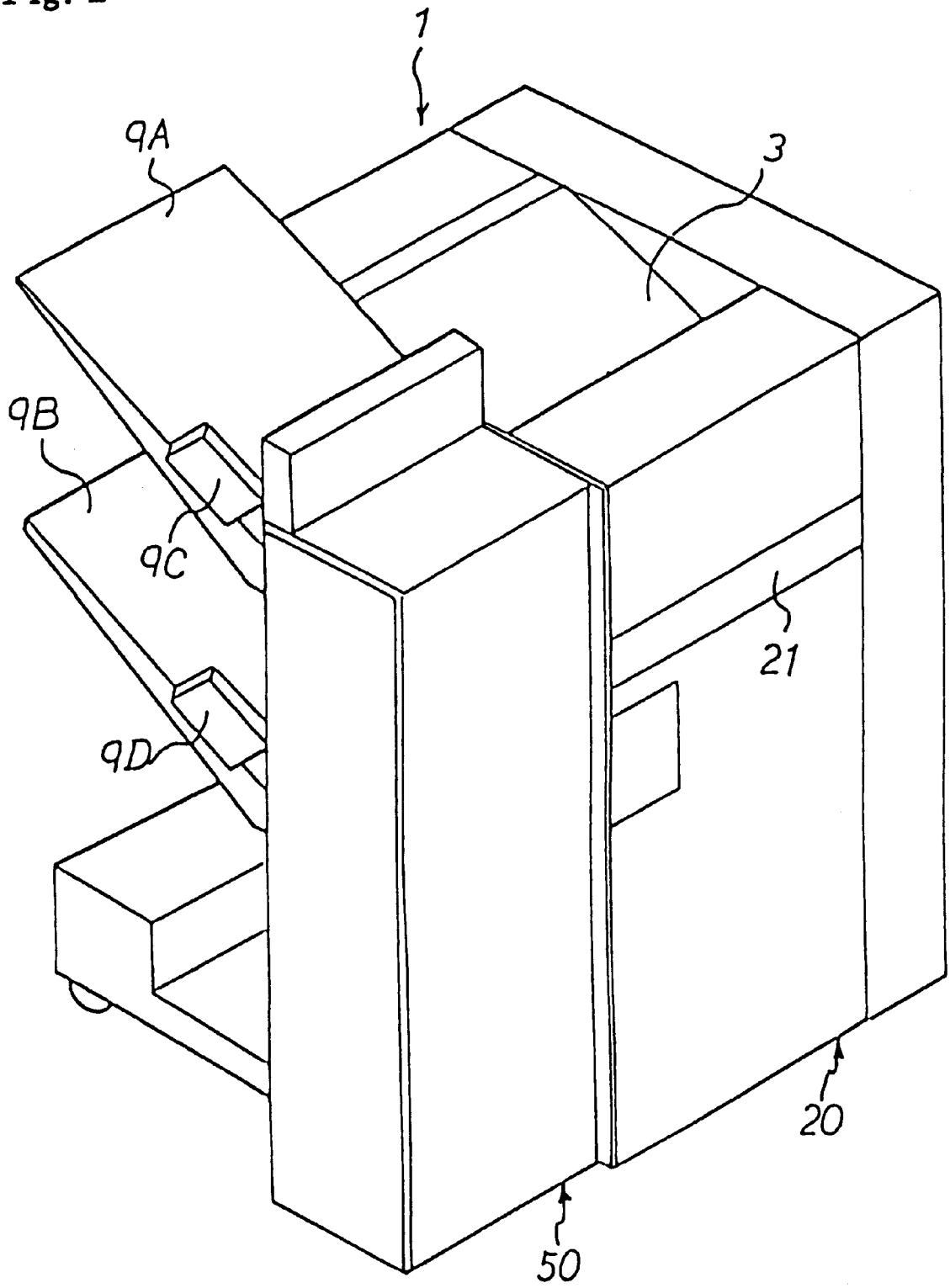
FIG. 2 is a perspective view showing a rear appearance of the sheet processing device.
Figure 3:
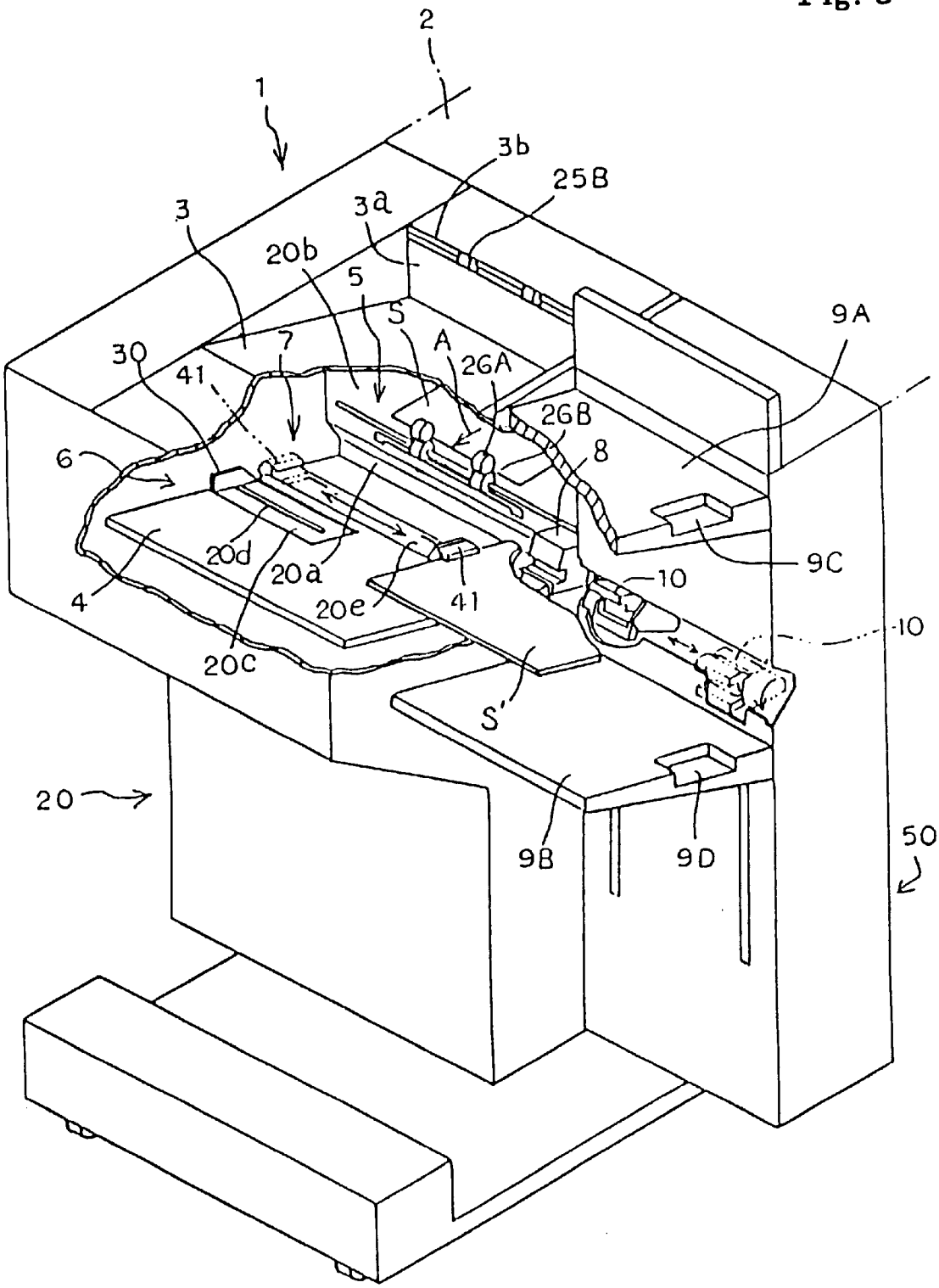
FIG. 3 is a partially broken perspective view showing the appearance of the sheet processing device.

In FIGS. 1 to 3, a sheet processing device 1 is provided with a post-processing device unit 20 and an accumulation processing device unit 50, each unit being constituted of an independent housing.

Figure 4:
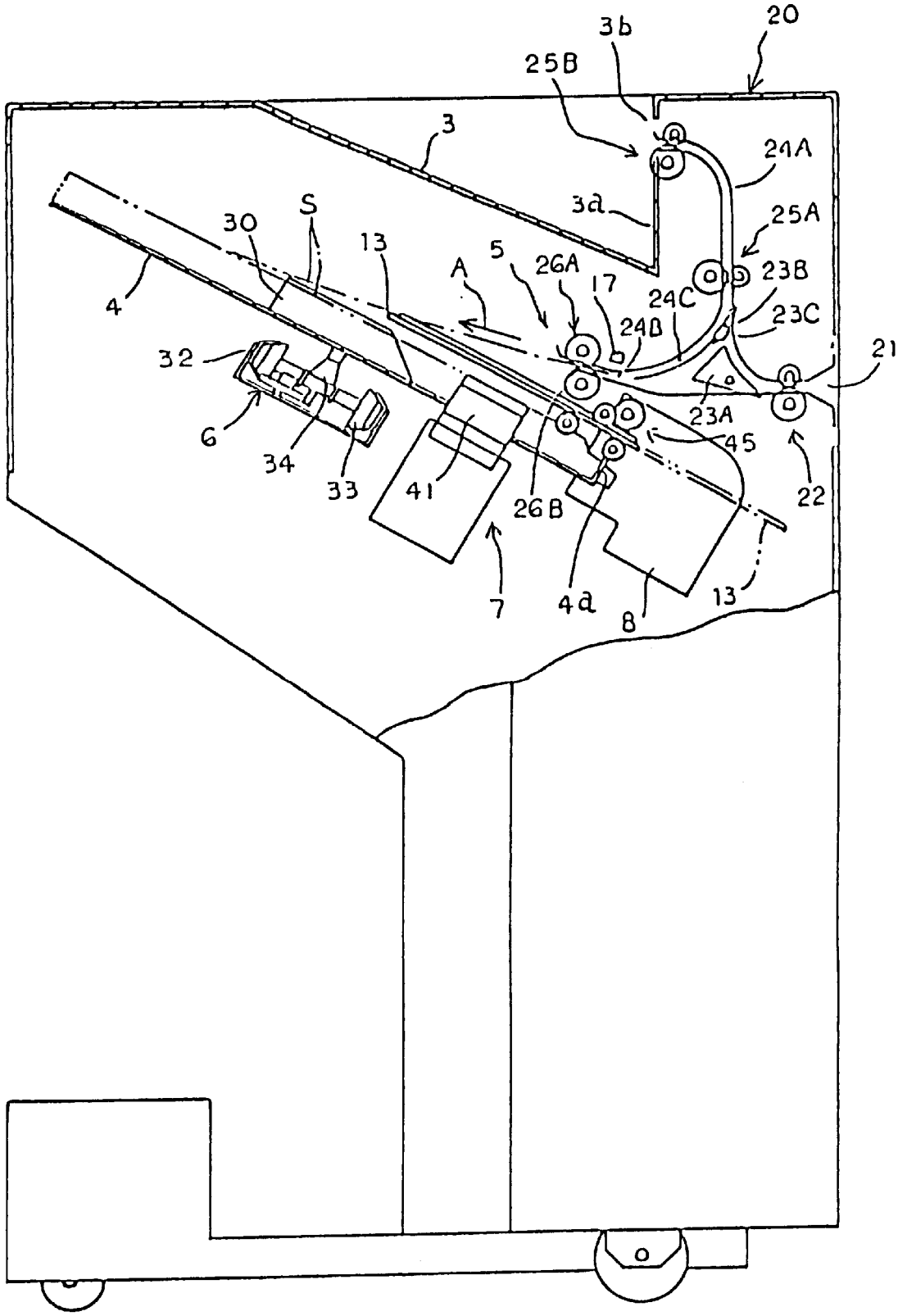
FIG. 4 is a partially broken side view of a post-processing device unit.

The post-processing device unit 20 is provided with, as shown in FIG. 3, a preparatory conveying means 5 for sorting sheets S with images formed thereon successively discharged from a copying machine 2 to an accumulating tray 3 if a post-processing is unnecessary and to a processing tray 4 if the post-processing is necessary; a matching means 6 for matching the plural sheets S received on the processing tray 4; a first holding means 7 for holding and conveying a matched sheet bunch S'; a stapler 8 for stapling the sheet bunch S' held by the first holding means 7; and, as shown in FIG. 4, an auxiliary tray 13 positioned above the processing tray 4 and below the preparatory conveying means 5.

Furthermore, as shown in FIG. 3, the post-processing device unit 20 is provided with a vertical wall 20*a* functioning as a storing reference surface of the sheets S relative to the processing tray 4; an opening 20*b* via which the sheets S are discharged; rail grooves 20*c* and 20*d* for allowing matching members 30 and holding members 34 described later to move; a rail groove 20*e* for allowing the first holding means 7 to move; and an opening 20*f* (FIG. 1) for allowing the sheet bunch S' held by the first holding means 7 and stapled to move from the processing tray 4 to two accumulating trays 9A and 9B.

Additionally, as shown in FIG. 1, the opening 20*f* is in parallel with the processing tray 4 and with the accumulating trays 9A and 9B. Therefore, the sheet bunch S' moves in parallel from the processing tray 4 to the accumulating trays 9A and 9B. Thereby, the alignment of the sheet bunch S' accumulated to the accumulating tray 9A or 9B is effectively maintained.

Figure 5:
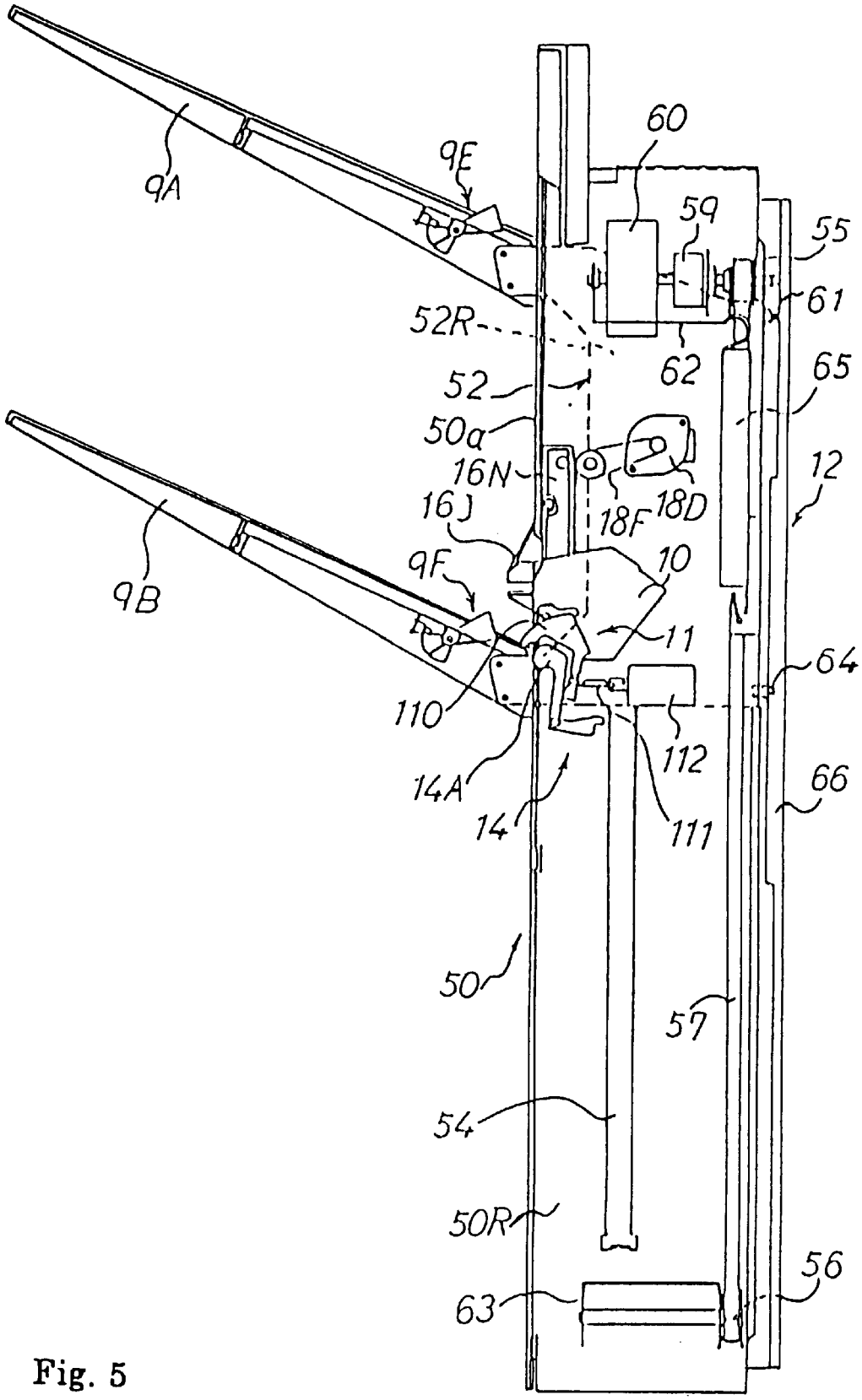
FIG. 5 is a side view showing an inner structure of an accumulation processing device unit.
Figure 6:
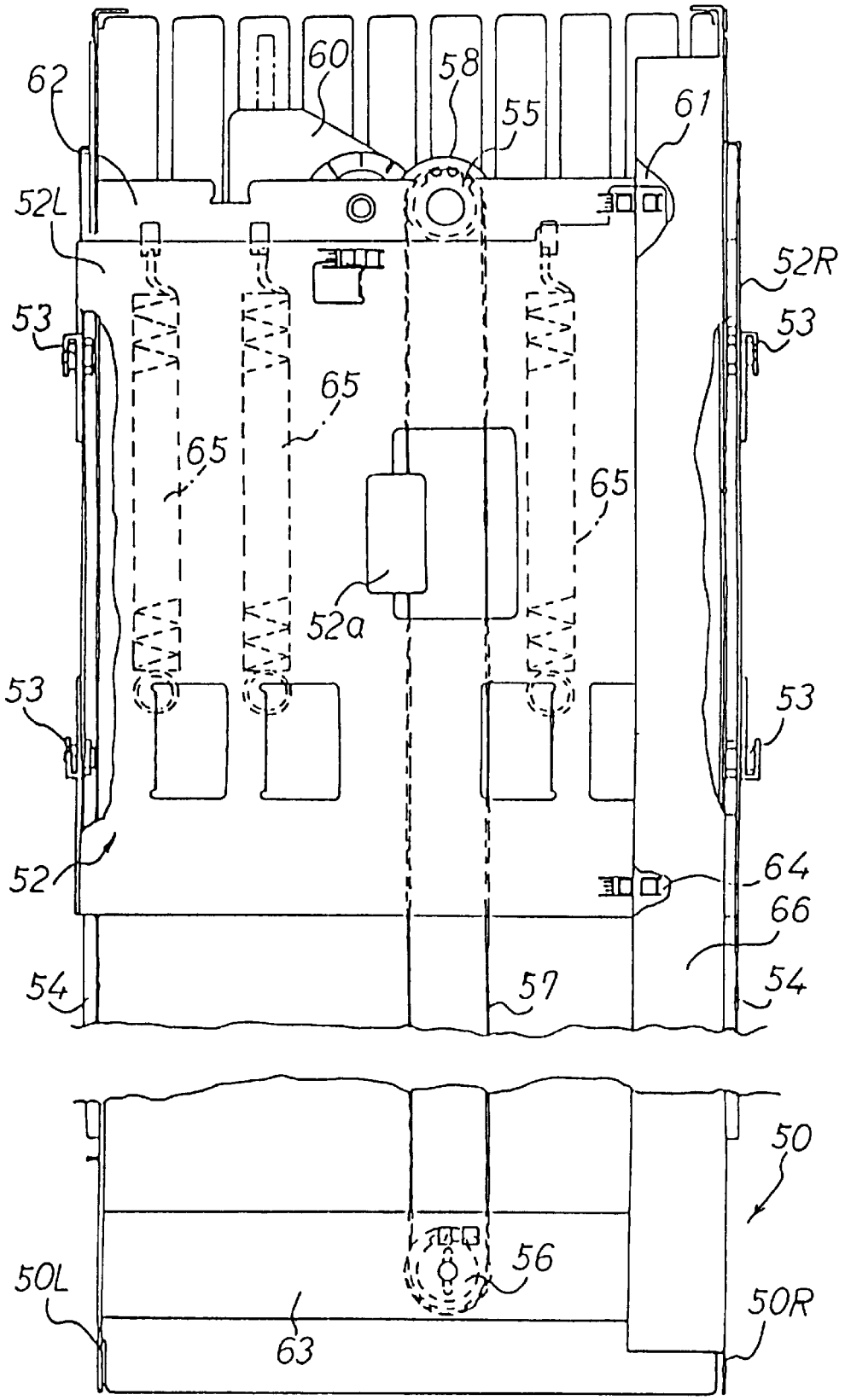
FIG. 6 is a front view showing an inner structure of the accumulation processing device unit.
Figure 7:
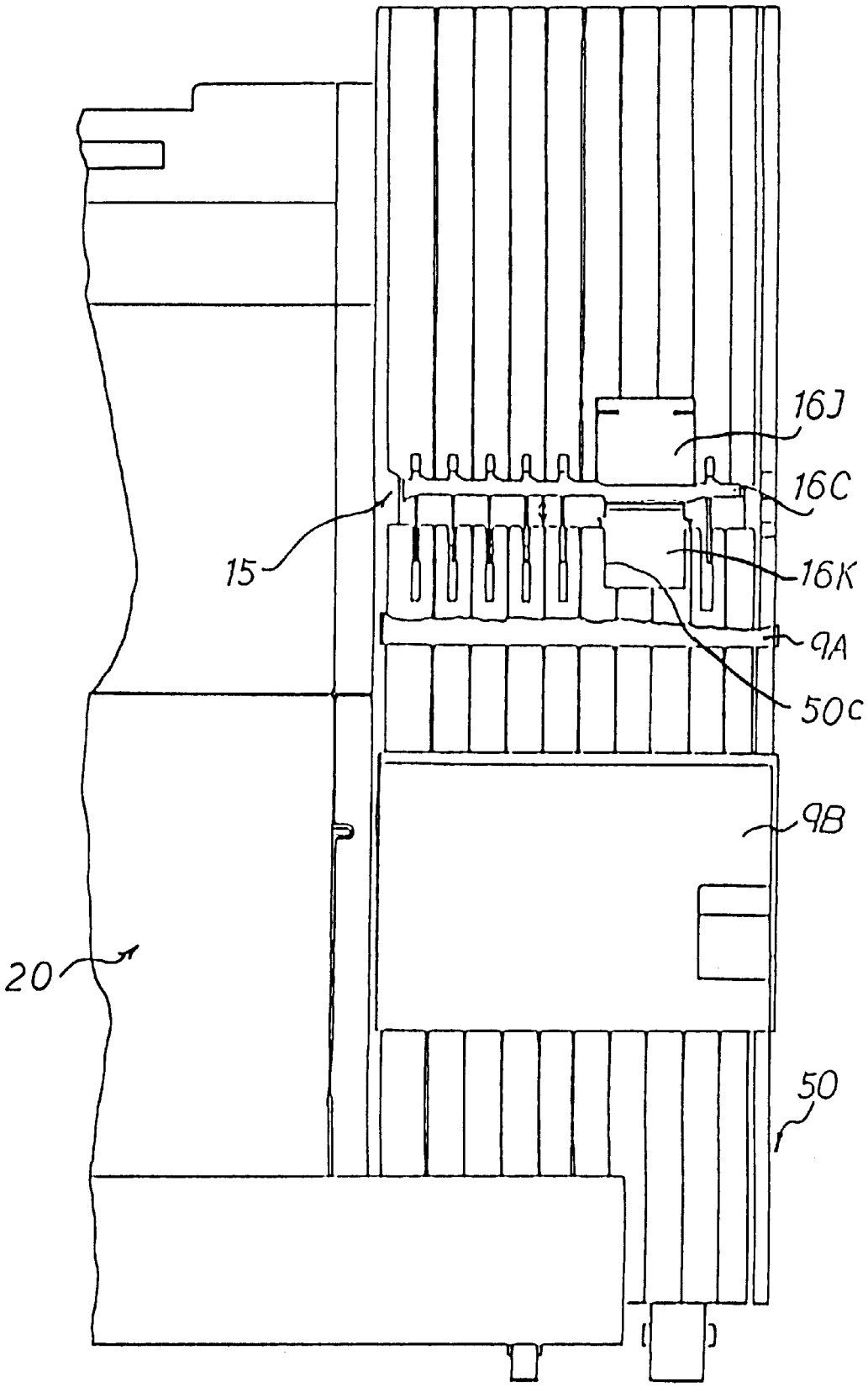
FIG. 7 is a front view showing an appearance of the accumulation processing device.
Figure 8:
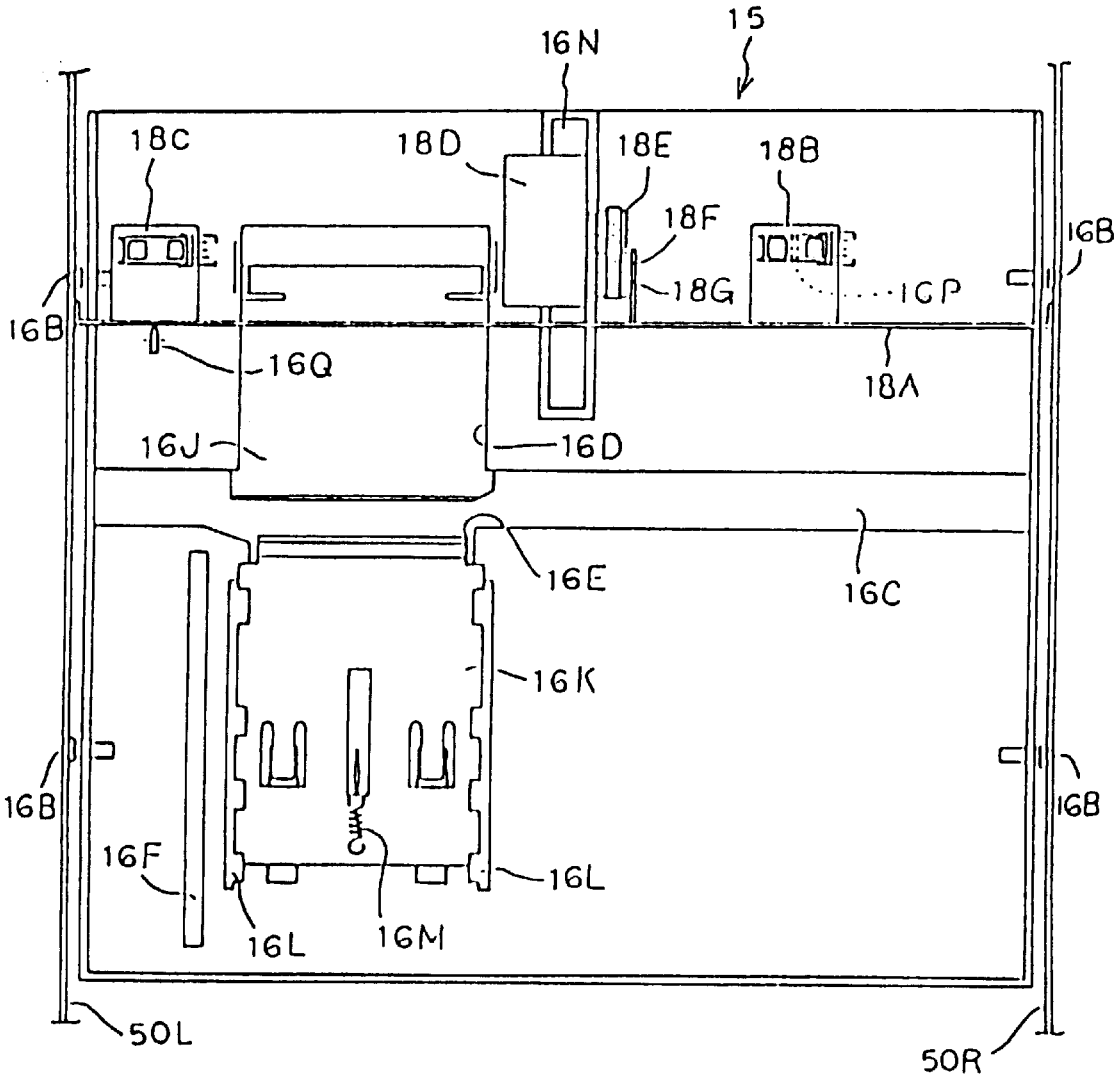
FIG. 8 is a rear view showing a structure of a shutter 15.
Figure 9:
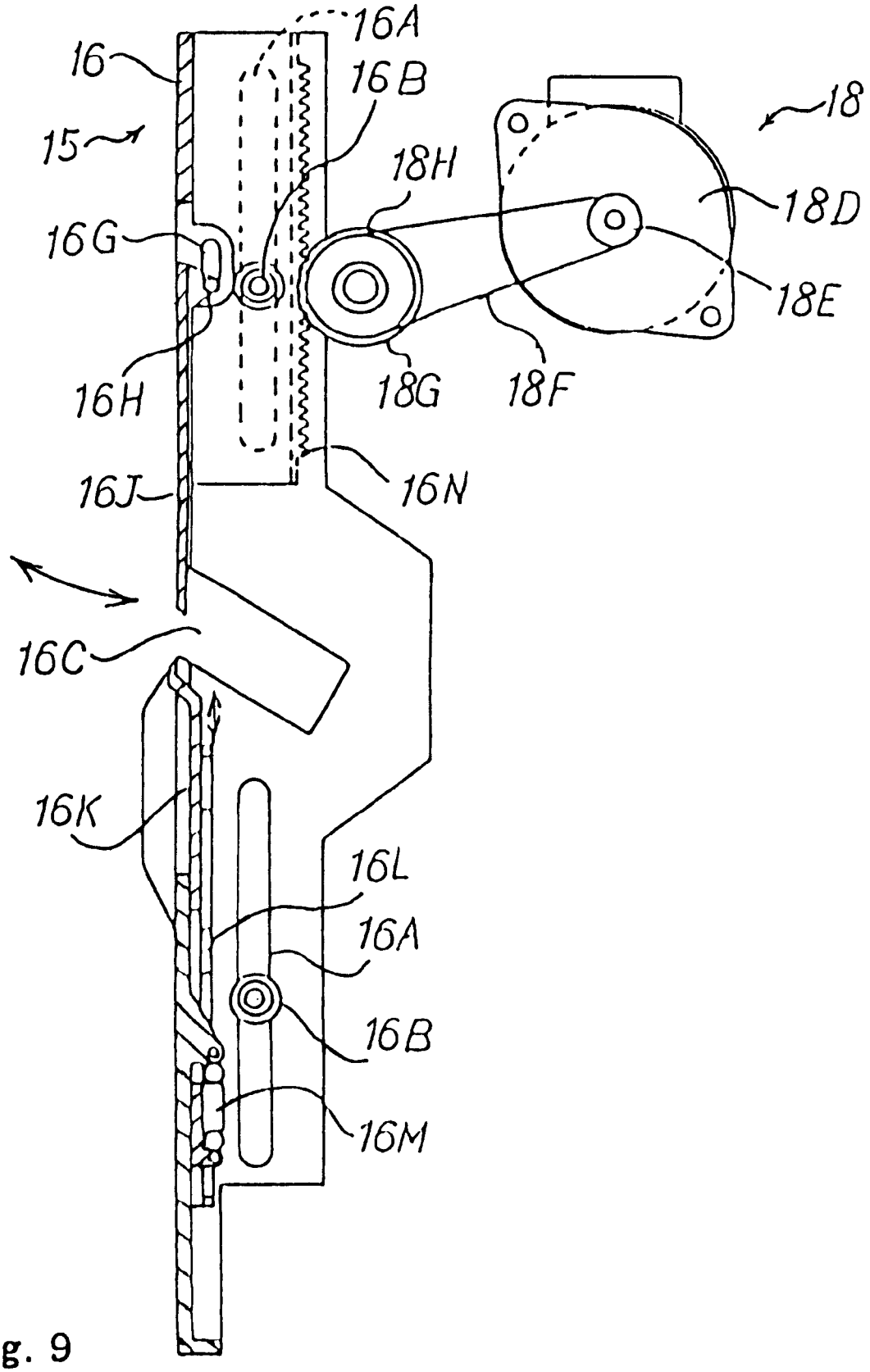
FIG. 9 is a side view showing a mechanism of the shutter 15.

The accumulation processing device unit 50 is provided with, as shown in FIG. 3, the accumulating trays 9A and 9B which can be raised/lowered to accumulate thereon the sheet bunch S' stapled by the stapler 8; a second holding means 10 for receiving and holding the sheet bunch S' held by the first holding means 7 and conveyed to the accumulating tray 9A or 9B and conveying the sheet bunch S' to a predetermined position on the accumulating tray 9A or 9B; as shown in FIGS. 5 and 6, a sheet height detecting means (sheet surface detecting sensor) 11 for detecting the height of the sheet bunch S' accumulated on the accumulating tray 9A or 9B; a halfway taking sensor 14 for detecting that an operator removes the whole or a part of the sheet bunch while the sheet bunch is being accumulated on the accumulating tray 9A or 9B; an elevating means 12 for raising/lowering the accumulating trays 9A and 9B; and, as shown in FIGS. 7 to 9, a shutter 15 for operating when the accumulating trays 9A and 9B are raised/lowered.

The accumulation processing device unit 50 is also, as shown in FIG. 1, provided with a positioning and matching vertical wall 50*a* onto which one side of the sheet bunch S' conveyed to the accumulating tray 9A or 9B abuts; a horizontal opening 50*b* for allowing the second holding means 10 to move in a horizontal direction; and a vertical opening 50*c* interconnected to the horizontal opening 50*b* for allowing the second holding means 10 to rotate in a vertical direction.

The accumulating tray 3 is, as shown in FIG. 3, formed by tilting an outer-frame upper portion of the post-processing device unit 20, and has its upstream side positioned below and its downstream side positioned above. Furthermore, a vertical wall 3*a* is extended from an upstream-side end of the accumulating tray 3, and a releasing opening 3*b* is formed in an upper portion of the vertical wall 3*a*.

As shown in FIG. 4, in the preparatory conveying means 5, a conveying port 21 is formed in one or rear side face of the post-processing device unit 20, and aligned with a discharge port (not shown) of the copying machine 2. On the downstream side of the conveying port 12 a pair of conveying rollers 22 are arranged and a flapper 23A is then provided for switching a conveying path of the sheets S between a path 24A on the side of the upper accumulating tray 3 and a path 24B on the side of the lower processing tray 4. Moreover, the conveying path 24A is provided with pairs of conveying rollers 25A and 25B, while the conveying path 24B is provided with a pair of discharge rollers 26A and 26B and a sensor 17. Additionally, in order to reverse the sheets and discharge the reversed sheets to the processing tray 4, a reversing path 24C is interposed between the conveying paths 24A and 24B. When a rear end of the sheet passes along a reversing flapper 23B disposed in the conveying path 24A, the pairs of conveying rollers 25A and 25B rotate in reverse, a conveying direction of the sheet is reversed, and the sheet is supplied to the reversing path 24C. Additionally, a sensor 23C is attached to the reversing flapper 23B.

The processing tray 4 is positioned below the accumulating tray 3 and tilted in parallel with the accumulating tray 3. A series of sheets S is successively conveyed via the pair of conveying rollers 22 and the pair of discharge rollers 26A and 26B on a terminal end of the path 24B in a discharge direction A toward the processing tray 4, so that the sheets S are stapled by the stapler 8. As shown in FIG. 3, a tilted lower end portion of the processing tray 4 is raised or formed in a direction orthogonal to a tray surface, and an inner face of the raised portion forms the vertical wall 20*a* which abuts on one side of the sheet S extended back and forth in a direction orthogonal to the discharge direction A.

Figure 10:
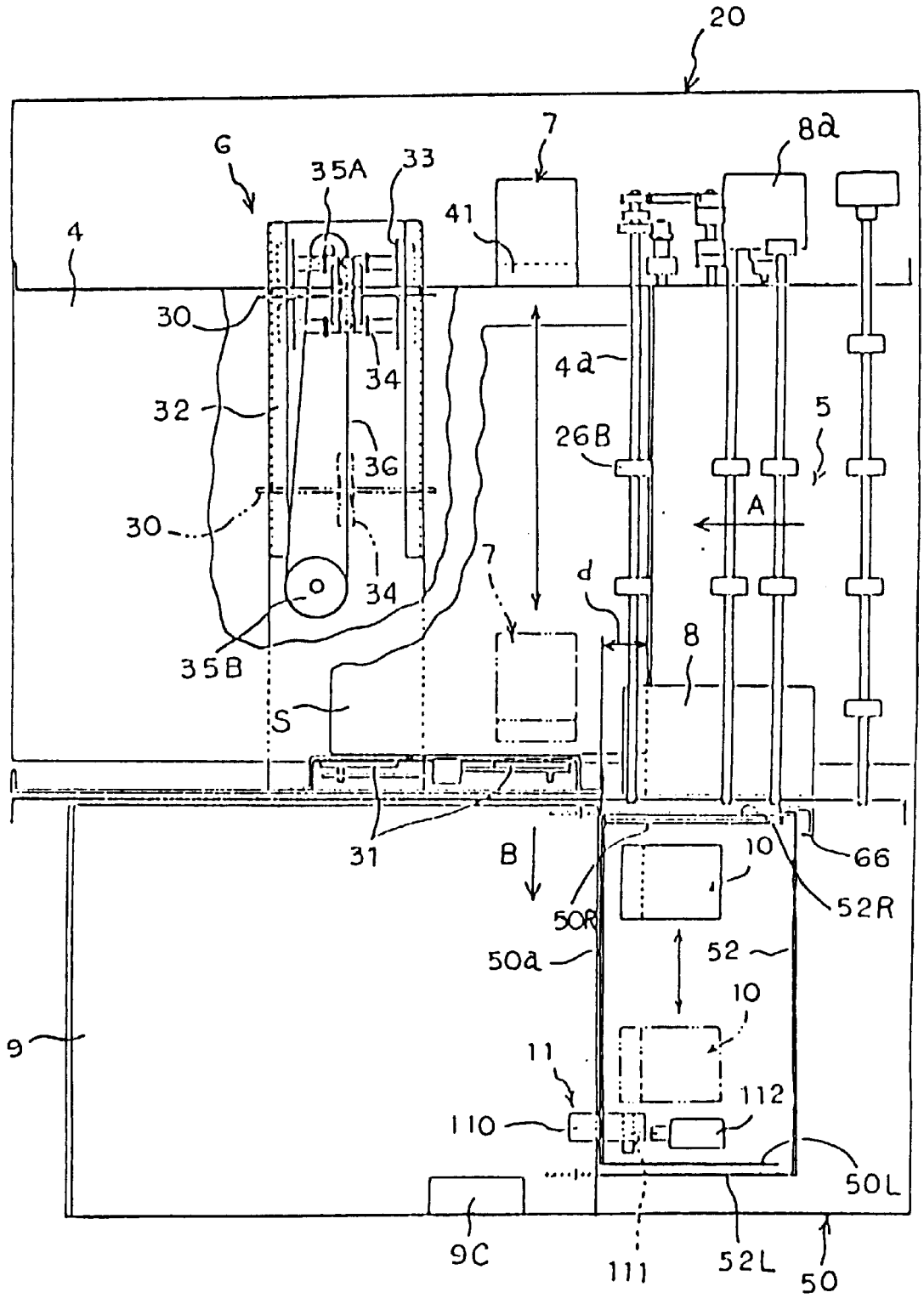
FIG. 10 is a sectional plan view of a sheet processing device.

In the matching means 6, in order to align the bunch S' of plural sheets stored on the processing tray 4, matching is performed before and after the discharge direction by bringing the sheets in contact with the reference surface 4*a* of the processing tray 4 as shown in FIG. 4. As shown in FIG. 10, on right and left sides of the discharge direction matching is performed by the matching members 30 arranged on opposite sides of the processing tray 4 and shutter type reference plates 31 which can be raised/lowered.

In a mechanism for moving the matching members 30, a rail 32 is extended in a transverse direction below the processing tray 4, holding members 34 are disposed for supporting the matching members 30 in such a manner that the matching members 30 can run inside the rail 32 via conical rollers 33, a belt 36 is extended between a pair of pulleys 35A and 35B, and the holding members 34 are partially fixed halfway to the belt 36. Additionally, one pulley 35B is operated by a matching motor 37 (refer to FIG. 17) to move the matching members 30.

While the sheets S are successively conveyed in the discharge direction A in this manner, the matching members 30 are in retreated and opened positions. After receiving the predetermined number of sheets S, the matching members 30 are advanced and pressed onto the reference plates 31 to perform matching.

Figure 16:
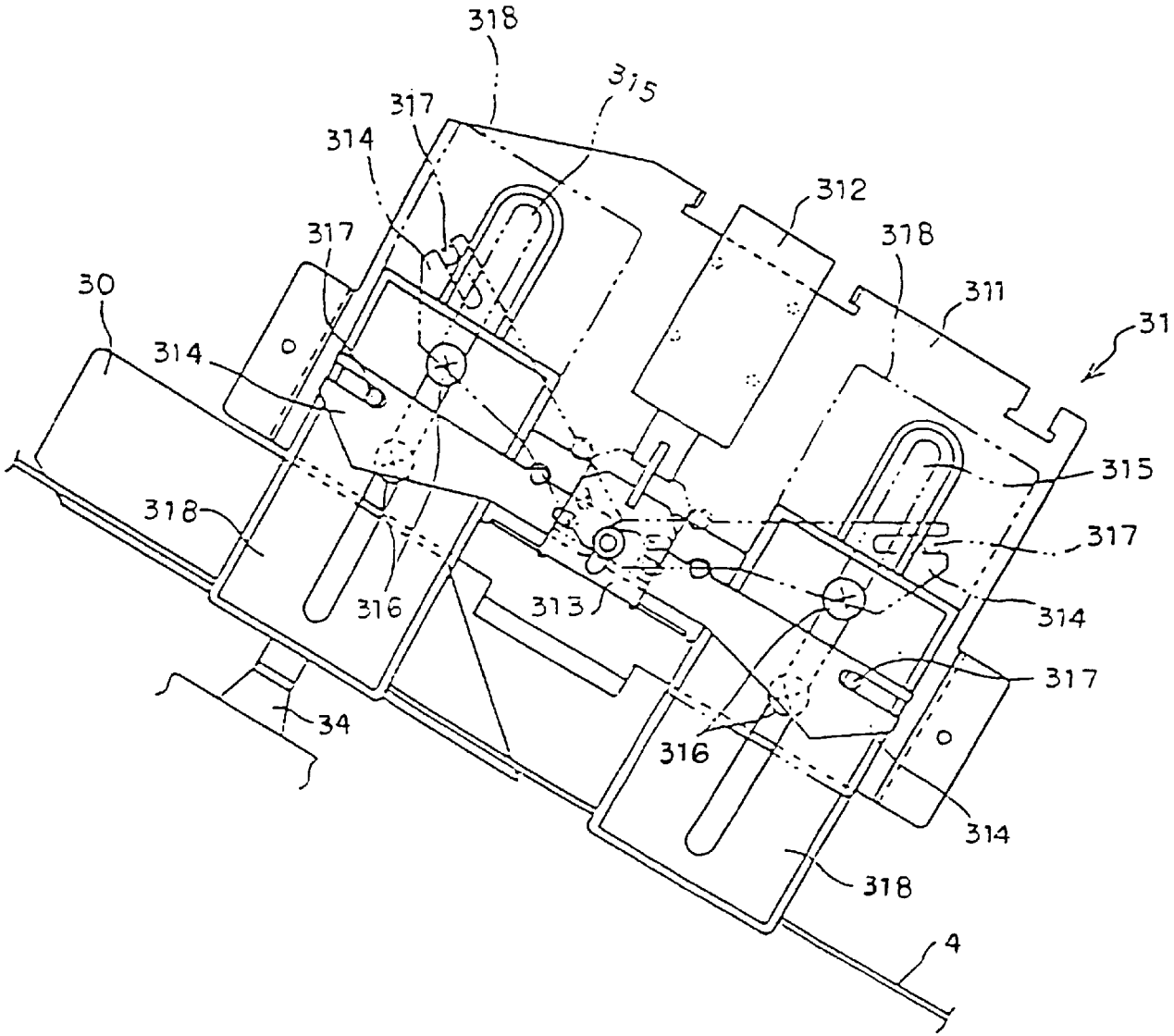
FIG. 16 is an enlarged front view showing a reference plate in the sheet processing device.

As shown in FIG. 16, the reference plate 31 is provided with a fixed plate 311 fixed to an inner wall of the post-processing device unit 20; a shutter solenoid 312 held by the fixed plate 311, an interconnection plate 313 provided on a tip end of the shutter solenoid 312; a pair of arms 314 having one ends interconnected to the interconnection plate 313; and shutter plates 318 interconnected to the other ends of the arms 314 via interconnection pins 316 and 317 for converting rotational movement of the arms 314 to linear movement via guide grooves 315 formed in the fixed plate 311. Additionally, in the process of conveying one sheet bunch S' from the processing tray 4 to the accumulating tray 9A or 9B, when a sheet S forming a base of the next sheet bunch S' is discharged onto the processing tray 4, in order to match the base sheet S, the shutter solenoid 312 rotates the arms 314 in such a manner that the shutter plates 318 abut on a top surface of the sheet bunch S' being conveyed.

Figure 11:
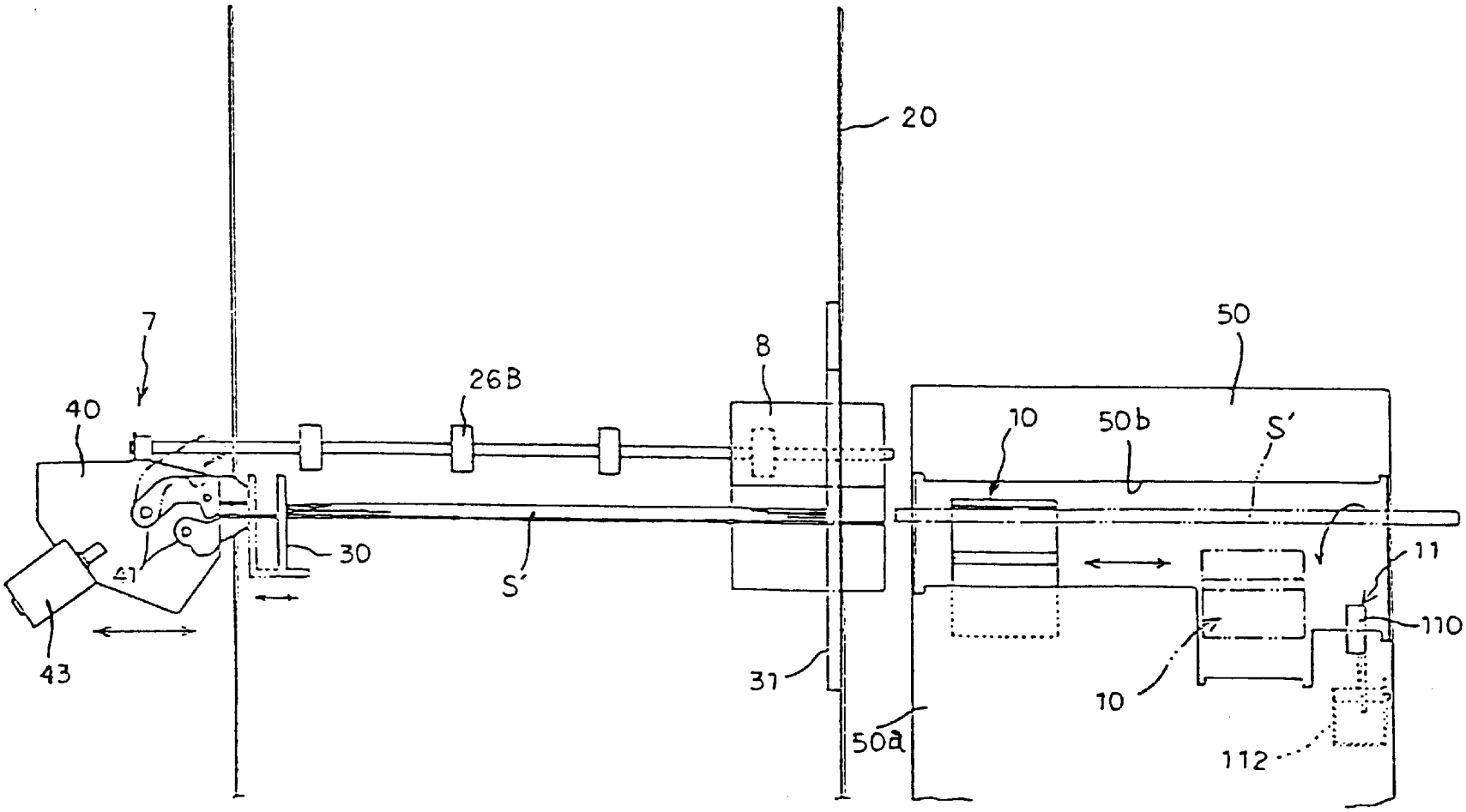
FIG. 11 is a schematic front view of the sheet processing device.

The first holding means 7 holds a rear-end portion of the sheet bunch S' matched on the processing tray 4 from above and below to convey the sheet bunch S' in a conveying direction B orthogonal to the discharge direction A. Furthermore, in the first holding means 7, as shown in FIG. 11, a moving frame 40 is provided with upper and lower holding levers 41 which are opened/closed. A detailed mechanism is not shown, but when a bunch pressing solenoid 43 operates, one side of the sheet bunch S' is held by the holding levers 41. Moreover, the holding levers 41 are advanced/retreated by a holding lever motor 42 of FIG. 17.

Figure 14:
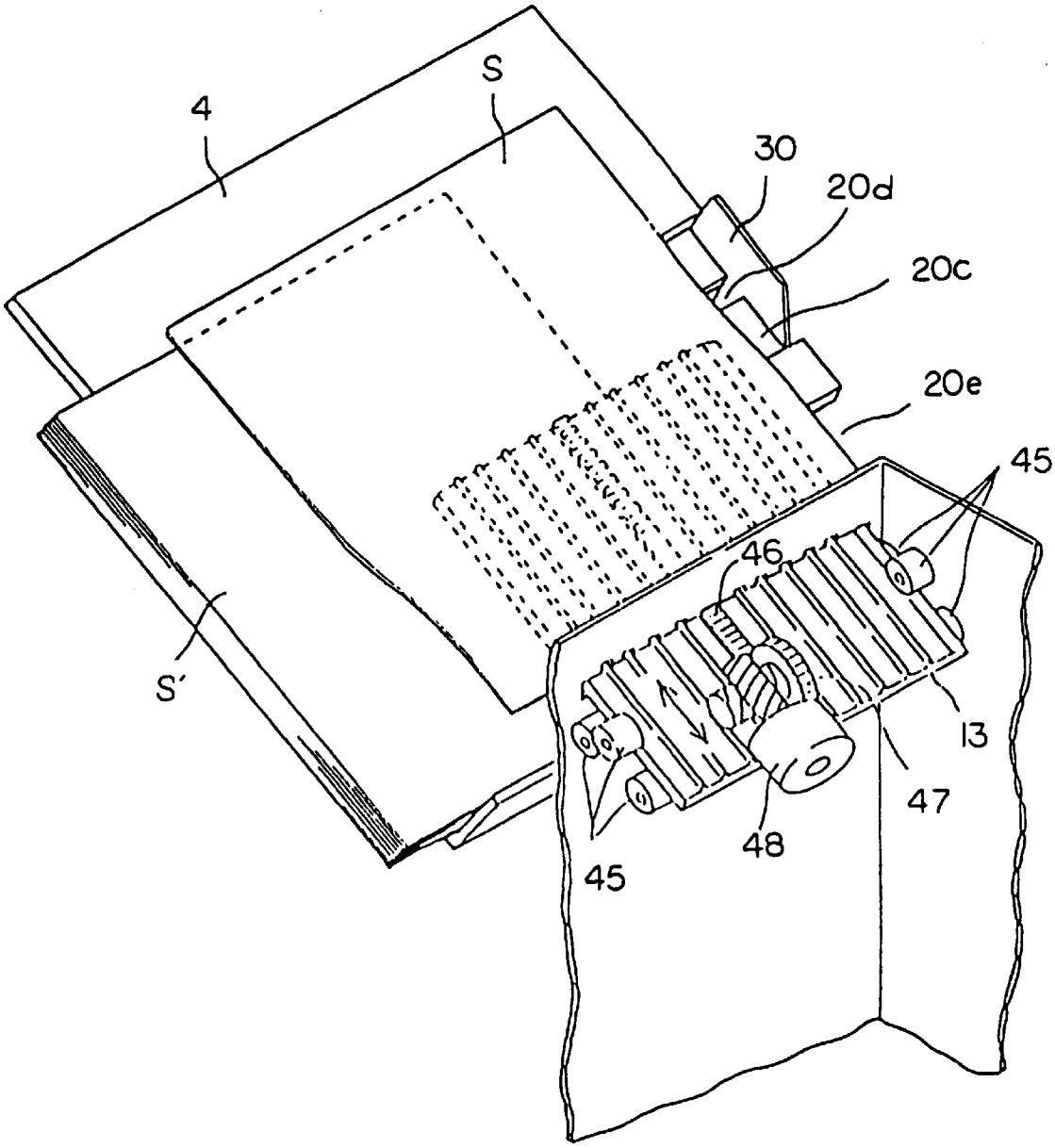
FIG. 14 is a perspective view of an auxiliary tray in the sheet processing device.

Above the processing tray 4 the auxiliary tray 13 formed in a flat plate as shown in FIGS. 4 and 14 is disposed between the processing tray 4 and the pair of discharge rollers 26A and 26B which are rotated by a conveying motor 19. The auxiliary tray 13 is shorter and narrower than the processing tray 4, and disposed in a reference position of the processing tray 4 in such a manner that the auxiliary tray 13 can advance/retreat. Specifically, opposite end portions of the auxiliary tray 13 are slidably supported by upper and lower guide rollers 45, a pinion gear 47 is engaged with a rack 46 in a middle portion, and the auxiliary tray 13 is slid by the pinion gear 47 operatively interconnected to an auxiliary tray motor 48. Additionally, FIGS. 4 and 14 show that the auxiliary tray 13 is moved forward.

When a series of sheet bunches S' is discharged onto the processing tray 4 and the sheet bunch S' is matched, the auxiliary tray 13 is moved forward before the next series of sheets S is conveyed. By receiving the next sheets S, the auxiliary tray 13 separates the sheets S from the sheet bunch S' being conveyed (being stapled).

Figure 15:
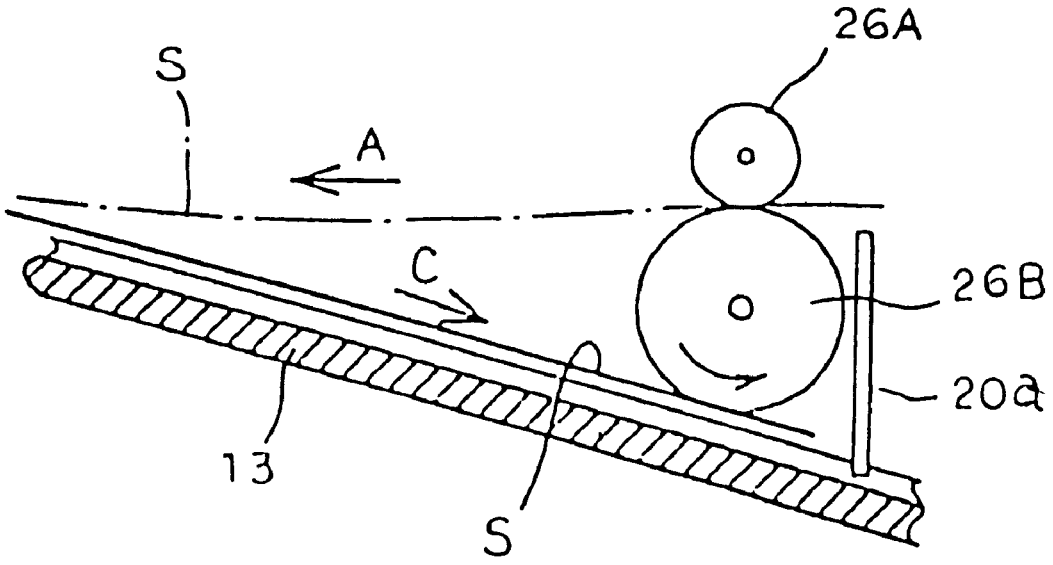
FIG. 15 is an explanatory view showing an operation of the auxiliary tray in the sheet processing device.

As shown in FIG. 15, the auxiliary tray 13 also has a returning function of conveying the sheet S in a returning direction C opposite to the discharge direction A when the sheet S is laid on the auxiliary tray 13. The returning function is performed by the discharge roller 26A and the discharge roller 26B which elastically abuts on the discharge roller 26A. Additionally, the diameter of the discharge roller 26B is larger than that of the discharge roller 26A, and the discharge roller 26B is formed of a soft material. When the outer peripheral face of the discharge roller 26B lightly abuts on the sheet S on the auxiliary tray 13, the tip end of the sheet S is forwarded in the returning direction C to abut on the contact plate 20*a*.

Furthermore, since the auxiliary tray 13 is loaded only with about one or two sheets S, a mechanism which is adapted to changes in thickness of the sheet S is unnecessary. Moreover, a timing of advancing/retreating the auxiliary tray 13 is set based on a detection result of the sensor 17 of FIG. 4 disposed on the upstream side of the discharge direction of the sheet S discharged by the discharge means or rollers 26A and 26B for detecting that the tip end of the sheet discharged by the discharge rollers 26A and 26B reaches the processing tray 4 or a position above the previous sheet S accumulated on the processing tray 4.

Specifically, as shown in FIG. 3, the plural rail grooves 20*c*, 20*d* and 20*e* in the processing tray 4 are extended in a direction orthogonal to the conveying direction of the sheet S. Therefore, in the case where no sheet S is accumulated on the processing tray 4, if the first sheet S is directly discharged on the processing tray 4, the tip end of the sheet S is buckled or caught in the rail groove 20*c*, 20*d* or 20*e* in accordance with the height of the processing tray 4, or another problem occurs. Additionally, even when the sheets S are accumulated on the processing tray 4, the tip end of the next sheet S abuts on the previous sheet S and is buckled. Furthermore, the aforementioned sheet bunch S' needs to be separated from the next sheet S.

To solve the aforementioned problem, by detecting the tip end of the sheet S by the detecting sensor 17, the auxiliary tray 13 is advanced, while by detecting the rear end of the sheet S by the detecting sensor 17, the auxiliary tray 13 is retreated.

In this case, it can be assumed that plural sheet sizes are mixed in one sheet bunch S'. For this, based on the sheet size information transmitted from the copying machine 2 and the sheet detection result of the detecting sensor 17, the retreating timing of the auxiliary tray 13 by means of the auxiliary tray motor 48 is set earlier as the sheet size is larger according to the sheet size information transmitted from the copying machine 2. Thereby, the sheet is prevented from being buckled in accordance with the sheet size. Additionally, even if sheet sizes are not mixed, the retreating timing may be set earlier when the sheet size is larger than an optional sheet size (e.g., A4 sideways) as a reference.

When the sheet bunch S' on the lower processing tray 4 is conveyed to the accumulating tray 9A or 9B, the auxiliary tray 13 is retracted substantially simultaneously with completion of conveyance to the accumulating tray 9A or 9B, thereby dropping the sheet S on the auxiliary tray 13 down to the processing tray 4.

As shown in FIG. 14, when a relatively large-sized sheet S is conveyed to the processing tray 4, the sheet S on the auxiliary tray 13 is supported in such a manner that the sheet S hangs from the auxiliary tray 13 onto the processing tray 4. Additionally, when a small-sized sheet S is conveyed, the sheet S can be received only by the auxiliary tray 13.

The stapler 8 staples the vicinity of edges of the sheet bunch S' with staples (stapling needles), and is disposed in the vicinity of the front end portion of the vertical wall 20*a* of the processing tray 4 on the side of the accumulation processing device unit 50.

Stapling positions and the number of portions of the sheet bunch S' to be stapled by the stapler 8 are reached by conveying the sheet bunch with the first and second holding means 7 and 10. Specifically, when one portion of the sheet bunch is stapled, the sheet bunch is held and conveyed by the first holding means 7, stopped when the portion is aligned with the stapler 8 and stapled. When two portions are stapled, the sheet bunch is held and conveyed by the first holding means 7, and the first portion is aligned with the stapler 8 and stapled. Subsequently, after the second holding means 10 in turn holds the sheet bunch, the second portion is aligned with the stapler 8 and stapled. Additionally, by providing the stapler 8 movably along the discharge direction A, portions to be stapled by the stapler may be variable.

The accumulating trays 9A and 9B are deviated ahead of the processing tray 4 or in a direction orthogonal to the discharge direction A and arranged in parallel with each other, and recesses 9C and 9D for taking the trays are formed in top-surface side edges of the accumulating trays. The accumulating trays 9A and 9B are also provided with sheet presence detecting sensors 9E and 9F.

As shown in FIGS. 5 and 6, the accumulating trays 9A and 9B are arranged in such a manner that the trays are raised/lowered along side walls 50L and 50R of the accumulation processing device unit 50, and the vertical wall 50*a* of the accumulation processing device unit 50 is an accumulation reference plane. The accumulation reference plane is set at a distance d (refer to FIG. 10) in the discharge direction A from the vertical wall 4*a* of the processing tray 4.

Opposite transverse ends of the accumulating tray 9A or 9B are fixedly supported by the side walls 50L and 50R of a U-shaped elevating frame 52, and opposite rollers 53 of the elevating frame 52 are vertically movably guided along vertical grooves 54 formed in the side walls 50L and 50R.

Furthermore, upper and lower frames 62 and 63 on the rear side of the accumulation processing device unit 50 are provided with pulleys 55 and 56, a belt 57 is extended between the upper and lower pulleys 55 and 56, and a follower gear 58 fixed to a rotation shaft of the pulley 55 is engaged with a drive gear 59 of an accumulating tray motor 60 to rotate and operate the upper pulley 55. The elevating frame 52 is fixed halfway to the belt 57 with a fixture 52*a*, and vertically moved as the belt 57 runs.

A spring 65 is also attached between the elevating frame 52 and the upper fame 62, an upward carrying force is obtained from a biasing force of the spring 65, and an alleviating mechanism is constituted in which the weight of the sheet bunch S' on the processing tray 4 is prevented from excessively acting on the accumulating tray motor 60.

The elevating frame 52 is provided with a transmission type upper tray position detecting sensor 61 and a lower tray position detecting sensor 64, so that the positions of the accumulating trays 9A and 9B can be detected dependent on whether or not light is interrupted by a shielding plate 66 attached to the side wall 50R.

Figure 12:
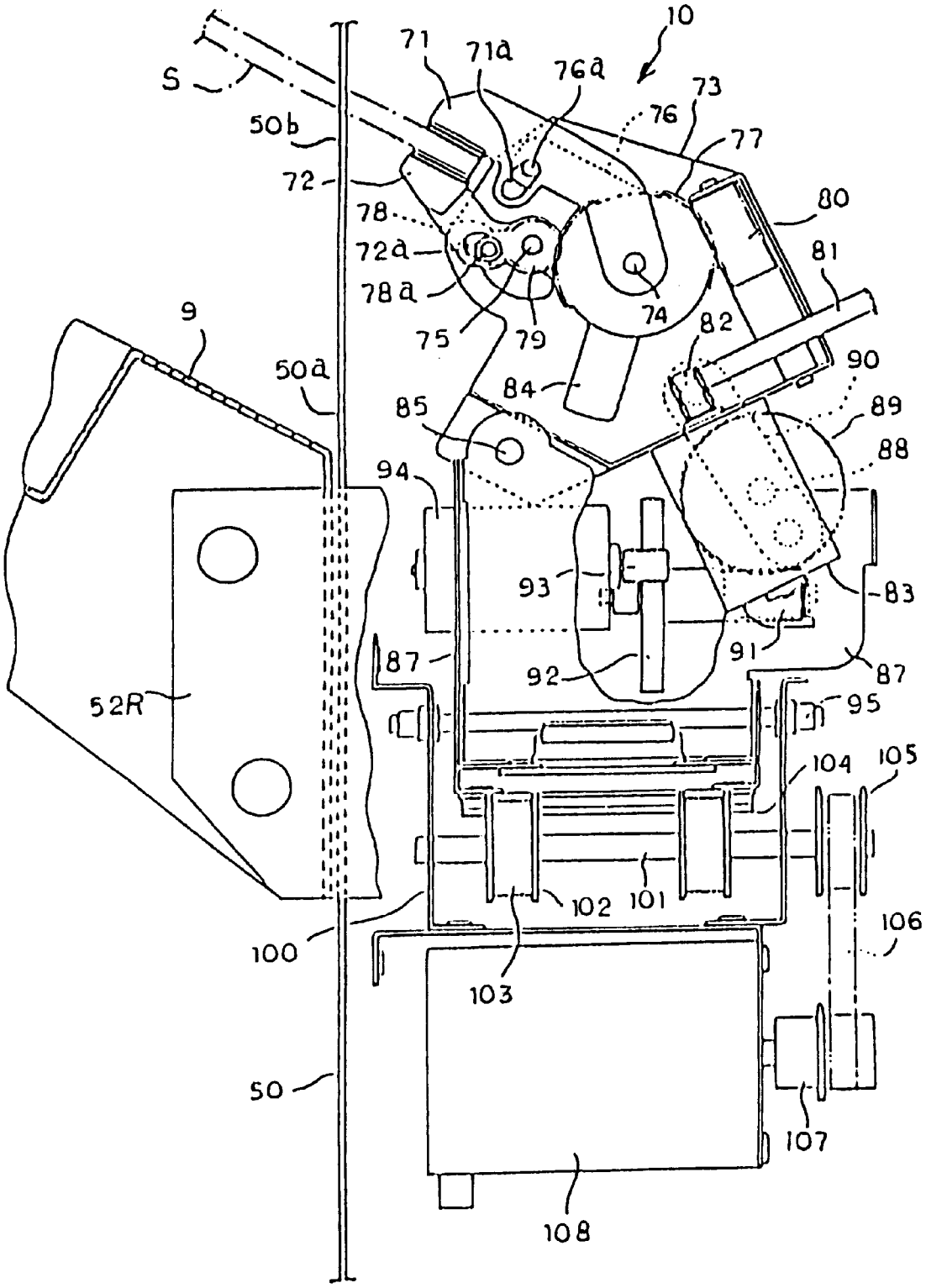
FIG. 12 is an enlarged sectional side view showing a main portion of a second holding means in an initial condition in the sheet processing device.
Figure 13:
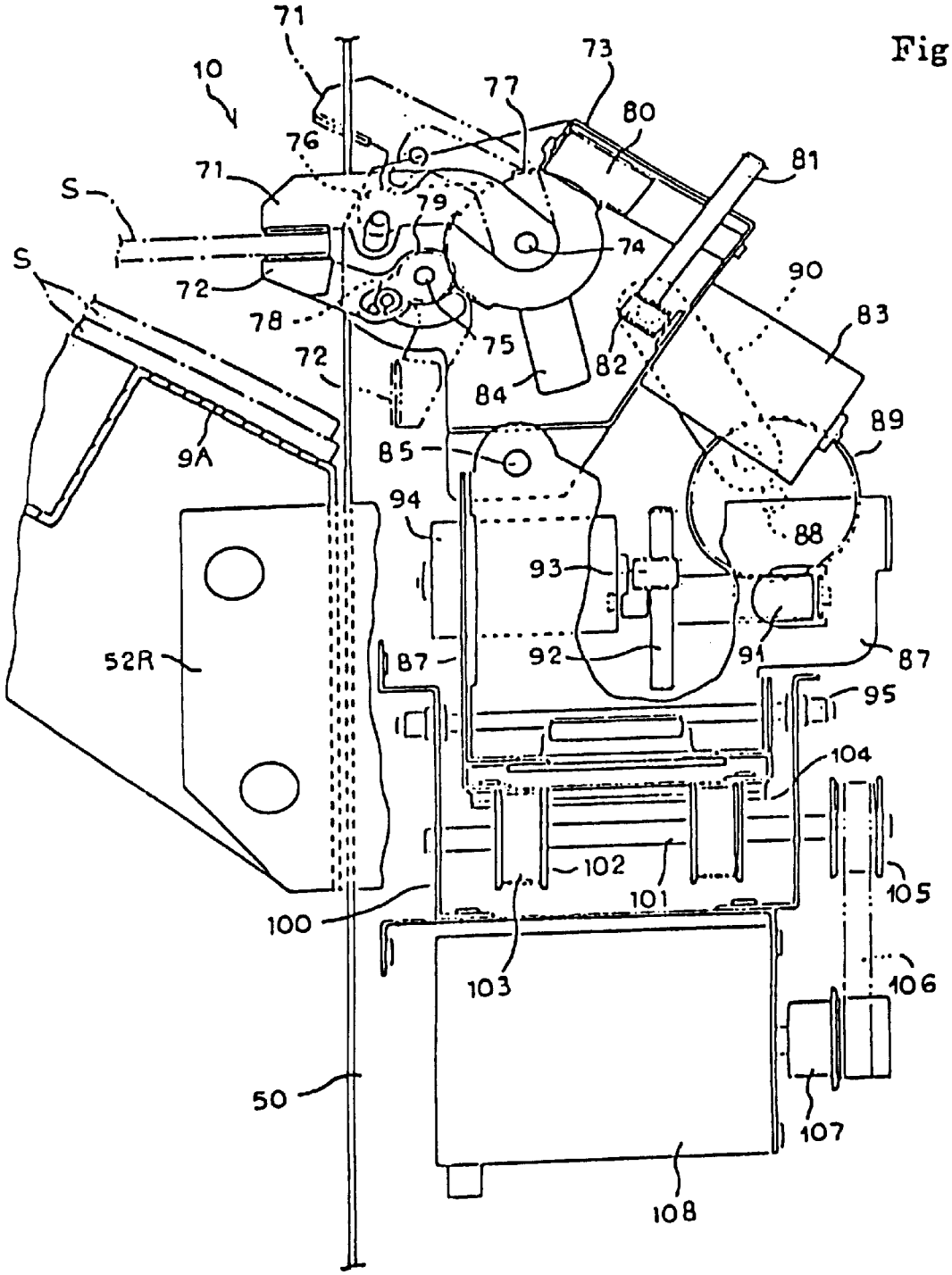
FIG. 13 is an enlarged sectional side view showing a main portion of the second holding means dropping a sheet bunch in the sheet processing device.

As shown in FIGS. 12 and 13, the sheet held by the first holding means 7 is conveyed and pushed from the processing tray 4 onto the accumulating tray 9A or 9B via the second holding means 10. The second holding means 10 also has upper and lower holding levers 71 and 72 for pressing with planes and holding top and under surfaces of the sheet bunch S'. The sheet bunch S' is held/released by an opening/closing mechanism, and the held sheet bunch S' is conveyed by a conveying mechanism in the conveying direction B orthogonal to the discharge direction A. Furthermore, a portion of the sheet bunch S' held in an inclined condition is swung horizontally by a swinging mechanism, and simultaneously moved slightly toward the accumulating tray 9A or 9B.

First, a proximal end of the upper holding lever 71 is rotatably supported by a first shaft 74 relative to a swinging frame 73, and the lower holding lever 72 is rotatably supported via a second shaft 75 by the swinging frame 73. A first arm 76 is supported by the first shaft 74 and rotated integrally with a partial gear 77, and a tip end pin 76*a* of the first arm 76 is engaged in a groove 71*a* in the upper holding lever 71 and operated to open/close. Similarly, a second arm 78 is supported by the second shaft 75, and a tip end pin 78*a* of the second arm 78 is engaged in a groove 72*a* in the lower holding lever 72 and operated to open/close. Additionally, a gear portion 79 is attached to a pivotal portion of the second arm 78, and engaged with the partial gear 77 of the first arm 76 to rotate the upper and lower holding levers 71 and 72 when the arms 76 and 78 are linked and rotated.

A pinion gear 80 supported by the swinging frame 73 is engaged with another portion of the partial gear 77, and a drive gear 82 of an opening/closing motor 83 with the swinging frame 73 attached thereto is engaged with an intermediate gear 81 rotated integrally with the pinion gear 80 to constitute an opening/closing drive mechanism. Additionally, for the opened/closed condition of the upper and lower holding levers 71 and 72, an operation piece 84 rotated integrally with the upper holding lever 71 is detected by a sensor (not shown).

When the second holding means 10 is opened/closed, the upper and lower holding levers 71 and 72 are different from each other in open angle because the diameter of the partial gear 77 of the upper holding lever 71 is large and the diameter of the gear portion 79 of the lower holding lever 72 is small. The upper holding lever 71 is opened by about 30°, while the lower holding lever 72 is opened downward by about 90° (refer to FIG. 13).

A lower end of the swinging frame 73 is swingably supported via a swinging shaft 85 by a moving frame 87. A rotary gear 89 is supported via a shaft 88 parallel with the swinging shaft 85 by the moving frame 87. An eccentric portion of the rotary gear 89 and a rear portion of the swinging frame 73 above the swinging shaft 85 are interconnected by a linkage 90. When the rotary gear 89 is rotated, the swinging frame 73 is swung via the linkage 90 to a retreated position of FIG. 12 or a protruded position of FIG. 13.

An outer peripheral gear portion of the rotary gear 89 is engaged with a pinion gear 91 supported in a direction orthogonal to the swinging shaft 85 by the moving frame 87, and an intermediate gear 92 integral with the pinion gear 91 is engaged with a drive gear 93 of a swinging motor 94 attached to the moving frame 87 to constitute a swinging mechanism.

In a conveying mechanism of the moving frame 87, a running member 95 transversely protruded before and after the moving frame 87 is engaged in a guide groove (not shown) extended back and forth in a guide frame 100 fixed to the device unit 50, and the moving frame 87 is supported in such a manner that the moving frame can move back and forth (in the conveying direction B).

Inside the guide frame 100 front and back pulleys 102 are supported by a pulley shaft 101 (another is not shown) and belts 103 are extended between the opposite pulleys. The moving frame 87 is fixed via a clamp member 104 to portions of the belts 103, a follower pulley 105 is fixed to an end of the pulley shaft 101, and a drive belt 106 is extended between the follower pulley 105 and a drive pulley 107 of a drive shaft of a conveying motor 108 attached to an under portion of the guide frame 100.

By rotating the conveying motor 108 forward or reversely, the moving frame 87 is advanced or retreated in the conveying direction B together with the second holding means 10. An initial position (home position) of the second holding means 10 is a receiving position closer to the processing tray 4, and the second holding means 10 is moved among the receiving position, an intermediate stop position for stapling the sheets with the stapler 8 and a most advanced release position. The second holding means 10 is opened/closed in the initial and release positions, and swung in the release position.

Furthermore, the conveying mechanism and the opening/closing and swinging mechanisms of the second holding means 10 are arranged inside a covering of the accumulation processing device unit 50, so that movement ranges are covered. The slit-like horizontal opening 50*b* is formed in an upper portion of the covering, and the second holding means 10 holding the sheet bunch S' moves along the horizontal opening 50*b*. Additionally, the swung upper and lower holding levers 71 and 72 are protruded from a release end.

As shown in FIG. 5, in the sheet height detecting means 11, a rotating detector 110 having a circular arc-shaped tip end is supported by the fixed frame, and protruded/retracted and rotated via a spring 111 when an actuator 112 is operated. The tip end of the rotating detector 110 can make contact with the top surface of the sheet bunch S' on the accumulating tray 9A or 9B, the top-surface position of the sheet bunch S' on the processing tray 4 is detected with the rotation quantity, and the rising/lowering of the processing tray 4 is controlled.

Operations of the mechanisms are linked and controlled in a control unit. On a control panel the number of sheets, the setting number, the necessity of stapling, the stapling position and the like are set by an operator. Operation of each section is controlled based on the setting.

When the accumulating tray 9A passes the horizontal opening 50*b* and is inclined, the shutter 15 prevents the sheet bunch S' on the accumulating tray 9A from being caught by or going into the horizontal opening 50*b*. The shutter 15 is provided with a shutter plate 16 for opening/closing the horizontal opening 50*b* and a drive section 18 for raising/lowering the shutter plate 16.

As shown in FIG. 9, long holes 16A are formed in upper and lower portions of opposite sides of the shutter plate 16 and, as shown in FIG. 8, the shutter plate 16 is vertically movably supported by pins 16B attached to the side walls 50L and 50R. The shutter plate 16 is also provided with a horizontal opening 16C and openings 16D to 16F.

As shown in FIG. 9, the opening 16D is covered with a movable plate 16J rotatably supported via a shaft 16H in a long hole 16G and, as shown in FIG. 5, the plate 16J is pushed out by rotation/operation of the second holding means 10.

Opposite sides of an elevating plate 16K are liftably supported by guides 16L in the opening 16E and, as shown in FIG. 5, the elevating plate 16K is pushed down by the rotation/operation of the second holding means 10. The elevating plate 16K is reset by a spring 16M. Therefore, when the second holding means 10 is not rotated, the movable plate 16J and the elevating plate 16K are closed safely.

The opening 16F is a hole via which the rotating detectors 110 and 14A of the sensors 11 and 14 go in/out.

The shutter plate 16 is also provided with a rack 16N, an opened position detecting lever 16P and a closed position detecting lever 16Q.

On the other hand, a support frame 18A is horizontally attached between the side walls 50L and 50R, and there are the drive section 18, a sensor 18B for detecting the opened position detecting lever 16P and a sensor 18C for detecting the closed position detecting lever 16Q.

The drive section 18 is provided with a pulse motor 18D, a timing pulley 18E, a timing belt 18F, a timing pulley 18G and a pinion 18H engaged with the rack 16N.

When a copying operation is started, the shutter plate 16 is lowered, and the horizontal opening 16C is aligned with the horizontal opening 50*b* and opened. When the copying of the set number of sheets is completed, the shutter plate 16 is raised to close the horizontal opening 16C.

Figure 17:
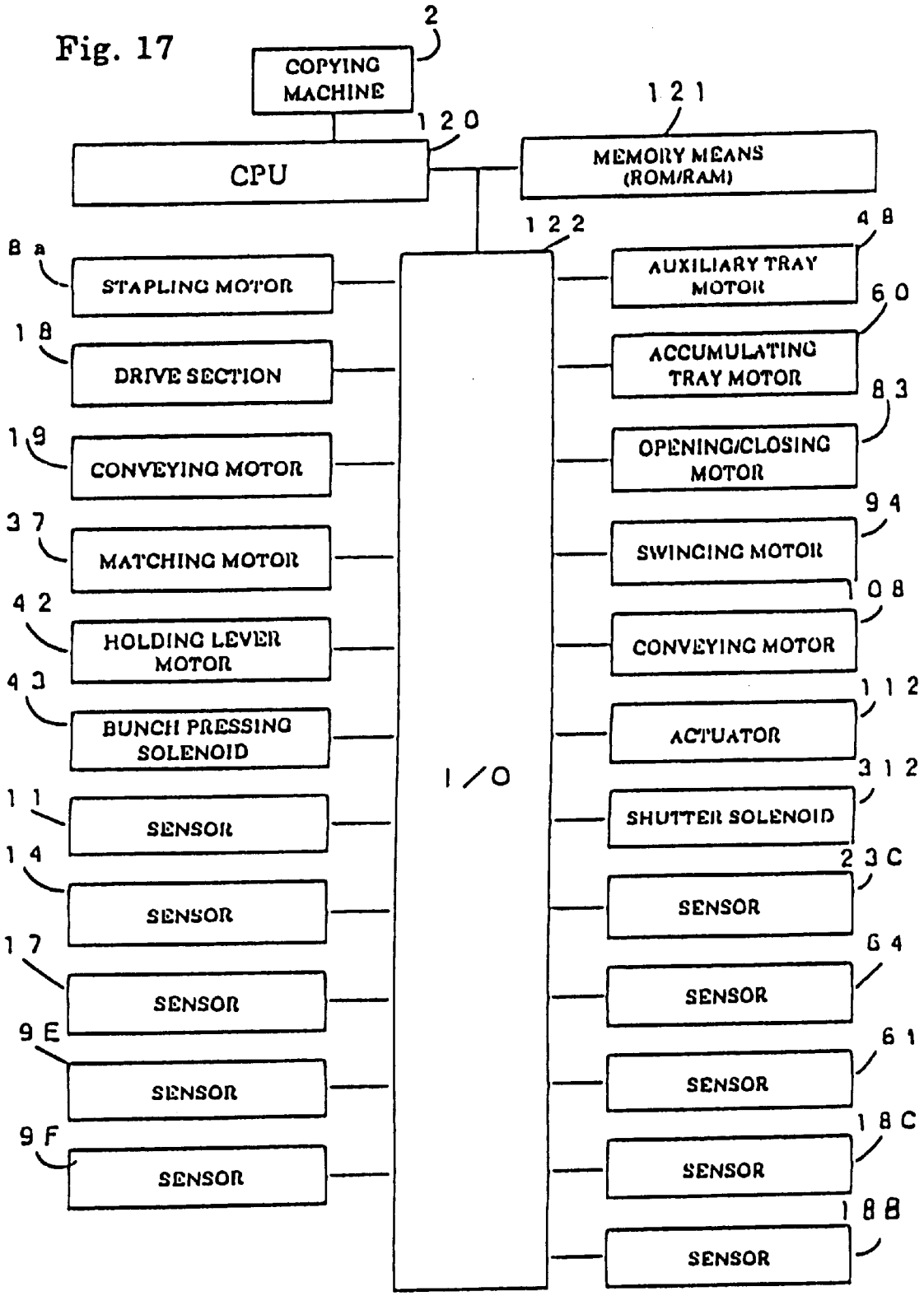
FIG. 17 is a block diagram of a control system in the sheet processing device.

In the aforementioned drive system, as shown in FIG. 17, in response to input/output signals from a CPU 120 and a memory means 121 such as a ROM, a RAM and the like, a parallel I/O 122 is operated and controlled.

Figure 18:
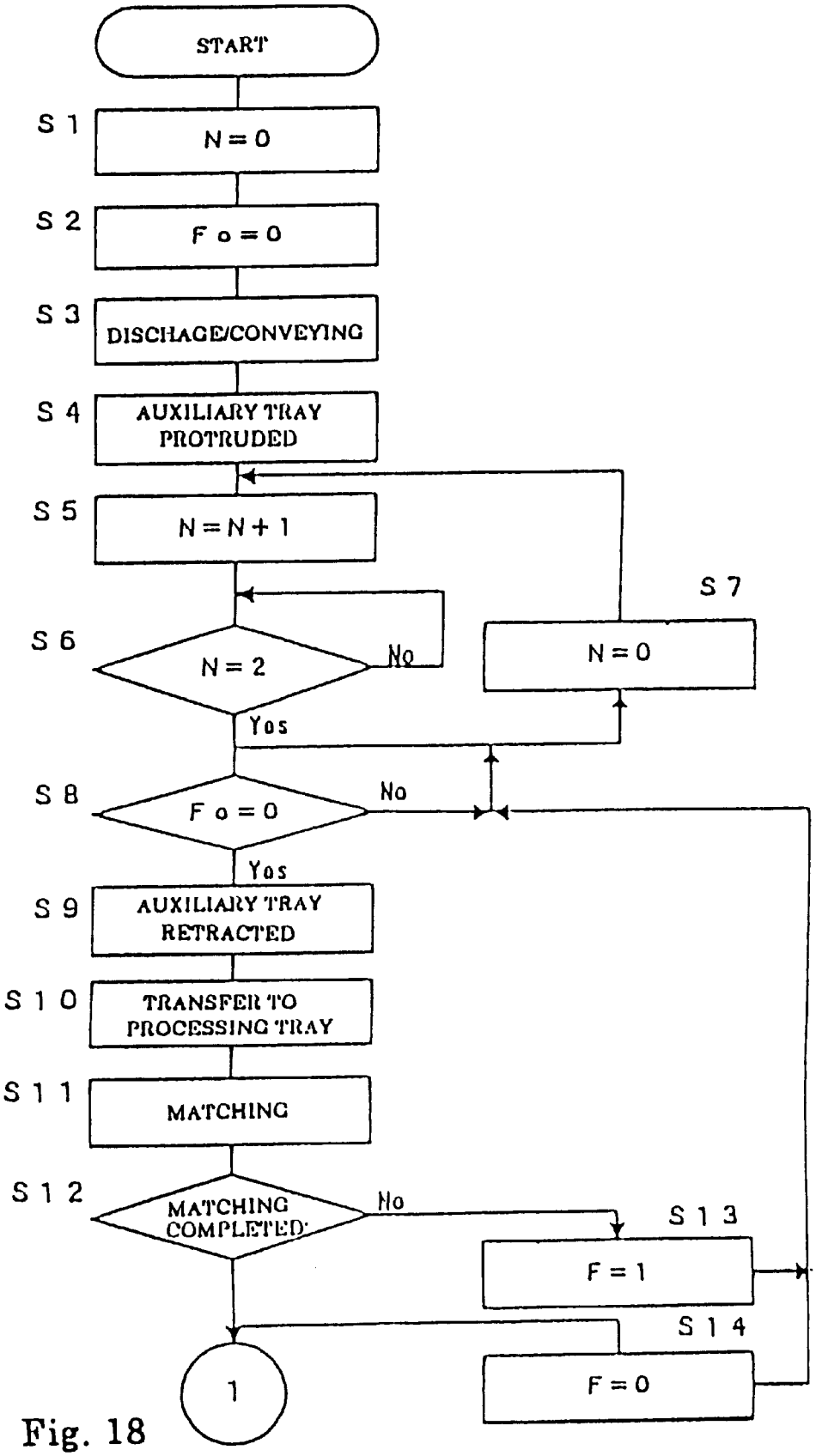
FIG. 18 is a first-half flowchart showing post-processing processes of the sheet processing device.
Figure 19:
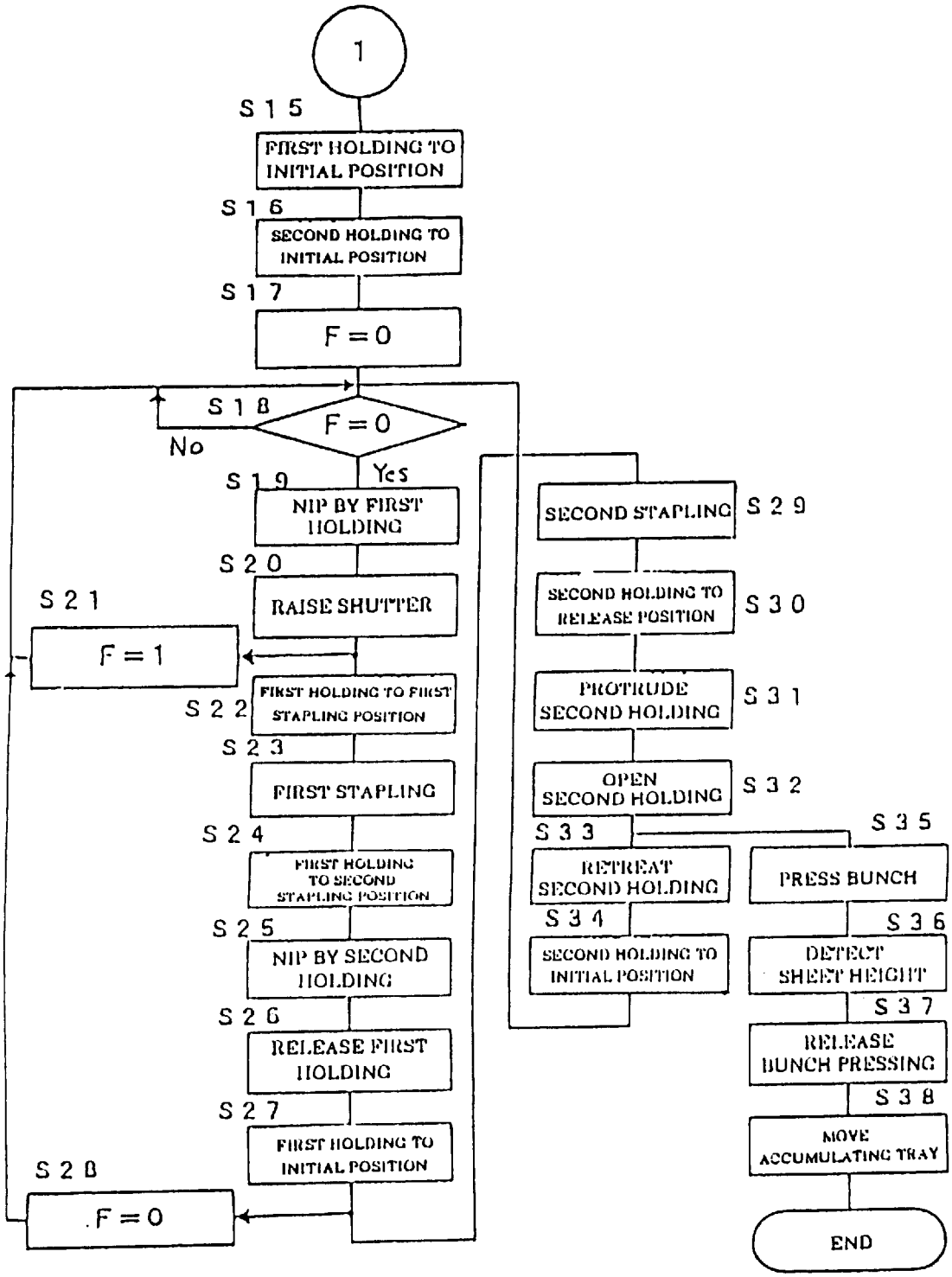
FIG. 19 is a latter-half flowchart showing the post-processing processes of the sheet processing device.
Figure 20:
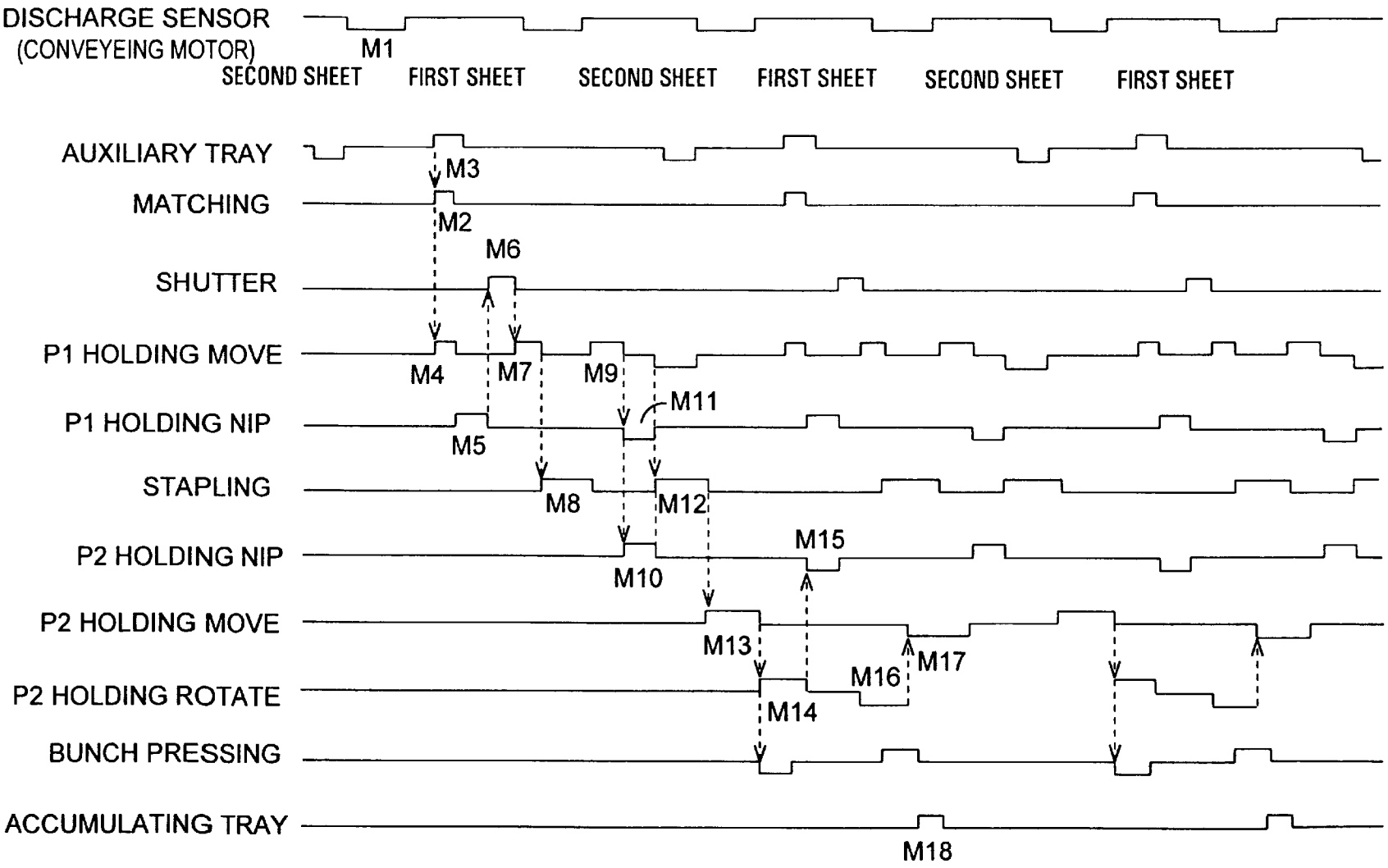
FIG. 20 is a timing chart showing the post-processing processes of the sheet processing device.

A post-processing process of the sheets S will be described with reference to FIGS. 18 to 21. Additionally, in a flowchart of FIGS. 18 and 19 showing a series of post-processing processes and a timing chart of FIG. 20, after stapling two sheets S (the same size) into a sheet bunch S', the bunch is accumulated. Furthermore, a numeral affixed to a code M in FIG. 20 indicates operation division or time in each section.

Dependent on conditions of the sheet presence detecting sensors 9E and 9F of the accumulating trays 9A and 9B and the tray position detecting sensors 61 and 64, either of the two trays 9A and 9B is moved to the discharge port. When an image forming operation of the image forming device 2 is started, the motor 18D is operated, the shutter plate 16 is lowered, the opened position detecting lever 16P is detected by the sensor 18B, then the motor 18D is stopped. In this condition, the horizontal opening 50*b* is aligned with the horizontal opening 16C of the shutter plate 16 and, as shown in FIG. 1, the opening 50*b* is opened.

In the flowchart, in an initial setting, the conveyed number of sheets discharged from the image forming device 2 is set to N=0, and a sheet matching flag is set to F0=0 (matching completed) by assuming that previously conveyed sheets are completely matched (S1, S2). The sheets S are successively discharged from the image forming device 2 (S3). In this case, the auxiliary tray 13 is protruded, the sheets are conveyed to increase the value of N and a series of plural sheets (two sheets) S are piled (S4, S5, S6) and the value is set to N=0 for the subsequent conveying (S7). When it is judged that the sheets are completely matched (S8), the auxiliary tray 13 is retracted, and the sheet bunch S' is dropped and stored onto the processing tray 4 (S9, S10), a lower inclined side of the sheet bunch S' abuts on the reference surface 4*a* as a storage end face and the sheet bunch S' is aligned in its transverse direction (M1: operation of a discharge sensor (not shown) and the conveying motor). Subsequently, the matching members 30 are moved to push the rear side of the sheet S and push the front side thereof onto the reference plates 31, so that the sheet S is matched in its back and forth direction (S11, M2: matching). During the matching of the sheet S (F0=1), the auxiliary tray 13 is protruded when the next series of sheets S is conveyed in (M3), and the sheet S is held to be separated from the sheet being matched/conveyed below (S11–S14).

Figure 21:
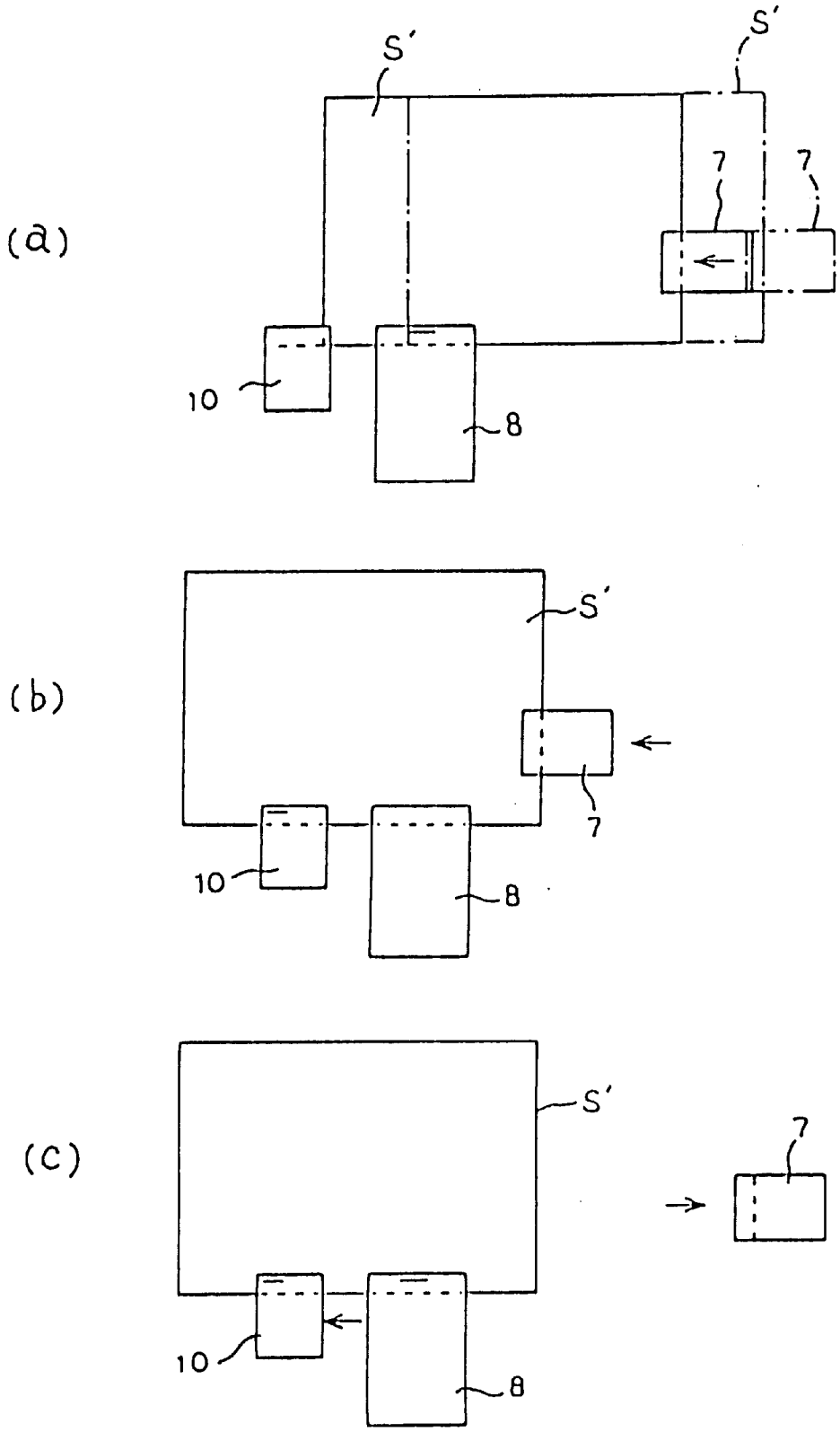
FIGS. 21A to 21C are explanatory views showing a process of transferring a sheet bunch from a processing tray to an accumulating tray in time series in the post-processing processes of the sheet processing device.

FIG. 21 shows a stroke in which the sheet bunch S' is transferred from the first holding means 7 over to the second holding means 10 while the sheet bunch S' on the processing tray 4 is conveyed toward, for example, the accumulating tray 9A (to the left as seen in FIG. 21). FIGS. 21A to 21C show that the conveying of the sheet bunch S' successively progresses, and the second holding means 10 and the stapler 8 are in fixed positions in the movement stroke.

When matching is performed, the first holding means 7 moves to an initial position (shown by a solid line of Fig. 10) (S15, M4). Moreover, at this time the second holding means 10 is in the initial position (shown by the solid line of FIG. 10) (S16). Here a flag indicating whether or not the sheet bunch S' is being transferred is set to F1=0 (not being transferred) (S17). In the matched condition, the rear side of the sheet bunch S' is held (nipped) by the first holding means 7 (S18, S19, M5, shown by a chain line in FIG. 21A).

The reference plates 31 (shutters) are raised (S20, M6). When a new sheet bunch S' is conveyed (F1=1, S21), the sheet bunch S' is allowed to move in the conveying direction B. Subsequently, the first holding means 7 is operated to move forward by a predetermined quantity, the sheet bunch S' is moved to a first stapling position in a direction of the accumulating tray 9A intersecting the discharge direction A (S22, M7, shown by a solid line in FIG. 21A) and the first portion is stapled by the stapler 8 (S23, M8). Additionally, the reference plates 31 are raised until the sheet bunch S' is conveyed in, then immediately lowered. In the lowering condition, the sheet bunch S' is lightly pressed, so that the sheet bunch S' can pass.

Subsequently, the first holding means 7 further moves forward and stops in a second stapling position (S24, M9, FIG. 21B, condition shown by a solid line in FIG. 3). The second holding means 10 is then stopped in the initial position on the side of the processing tray 4 (position shown by a solid line in FIG. 10 or 11), swung to a retreated position of FIG. 12 until the first holding means 7 stops, and receives and holds the reference-position side of the tilted sheet bunch S' while being stopped (S25, M10).

After the second holding means 10 holds the sheet bunch S' as aforementioned, the first holding means 7 is released (S26, M11, FIG. 21C), returns to a holding position (shown by the solid line in FIG. 10) to hold the next sheet bunch S' (S27) and allows the next sheet bunch S' to be transferred (S28). Subsequently, the second portion is stapled by the stapler (S29, M12). In each of the aforementioned stapling positions, the transfer quantity of the first holding means 7 is set based on an operator's instruction.

Subsequently, the second holding means 10 moves forward to a release position (shown by a chain line in FIG. 10 or 11), finishes conveying in the conveying direction B and stops (S30, M13). In the release position, the second holding means 10 is moved from the retreated swung position shown in FIG. 12 to the protruded position shown in FIG. 13, brought in a horizontal holding condition and moved in a direction orthogonal to the conveying direction B (S31, M14). Additionally, when the second holding means 10 swings from the retreated swung position of FIG. 12 to the protruded position of FIG. 13, the movable plate 16J is rotated and the elevating plate 16K is lowered by the second holding means 10.

An end portion of the sheet bunch S' aligned with the reference position on the processing tray 4 is held and conveyed by the second holding means 10 as shown in FIG. 12. When the second holding means 10 swings to the condition shown in FIG. 13, an end of the held sheet bunch S' is moved toward the accumulating tray 9A. The moved position is substantially aligned with the reference plane 50*a* in the accumulating tray 9A. Along with the movement the held sheet end becomes horizontal (M14), the upper and lower holding levers 71 and 72 are released and operated as shown by chain lines (S32, M15), and the held sheet bunch S' is dropped and released downward as it is and piled on the sheet bunch S' already accumulated on the accumulating tray 9A.

In this case, the sheet bunch S' is piled up without its end being largely deviated from the end of the accumulated sheet bunch S' below and without its dropped end being caught in the stapled portion of the sheet bunch S' below.

While the second holding means 10 is opened, the swinging frame 73 is retreated (S33, M16). Subsequently, the second holding means 10 is moved backward along the conveying direction B to return to the initial condition (S34, M17). In this case, even if the next sheet bunch S' is forwarded, the upper and lower holding levers 71 and 72 are sufficiently opened and, therefore, the sheet bunch S' fails to interfere with the upper and lower holding levers 71 and 72. Subsequently, in the initial position, the levers can be closed to hold the next sheet bunch S'.

When the second holding means 10 is swung to the horizontal condition (M14) as aforementioned, the actuator (bunch pressing solenoid) 112 is operated, the rotating detector 110 is placed in the sheet bunch pressing condition (S35), a sheet height is detected (S36), the operation of the actuator 112 is then canceled, and the pressing condition is released (S37, M18). When the accumulating tray 9A is higher than a predetermined position, it is lowered to a predetermined level by the elevating means 12 (S38, M19). Additionally, if an operator takes out the accumulated sheet bunch S' halfway, the accumulating tray 9A is raised in response to detection of the halfway taking sensor 14.

At the time of conveying the sheet bunch S' back and forth, since the second holding means 10 is moved/operated inside the covering, the second holding means 10 and its conveying mechanism fail to interfere with the operator who is trying to take the sheet bunch S' from the accumulating tray 9A. Moreover, since the held sheet bunch S' is conveyed, the matched condition of the sheet bunch S' is not disturbed during conveyance. Here, when it is detected by the sensor 11 that the predetermined number of or more sheets are stored on the accumulating tray 9A, the motor 60 shown in FIG. 5 is operated to raise the elevating frame 52 and stopped when the lower tray 9B moves to its storing position. Additionally, the shutter 15 is closed, and the sheet on the accumulating tray 9A does not go into the horizontal opening 50*b*. Thereafter, sheet bunches are similarly accumulated on the accumulating tray 9B.

Additionally, in the embodiment, the first and second holding means 7 and 10 are constituted of the holding levers for pressing with their planes and holding the sheets, but may be constituted of rollers or other members for pressing and holding the sheets from above and below. The conveying mechanism in each section can be varied, and the actuator can be replaced with a known mechanism.

Furthermore, in the embodiment, the invention is applied to the copying machine 2 as the image forming device, but the invention may be applied to the copying machine 2 in both digital and analog systems. Additionally, it is natural to apply the invention to a printer (including a laser printer), a facsimile machine or other various image forming means (image record device).

As aforementioned, the accumulation processing device unit 50 disclosed herein is provided with, as shown in FIG. 4, the preparatory conveying means 5 for conveying the sheets S with images formed thereon successively discharged from the copying machine or another image forming device to the processing tray 4; the matching means 6 for matching the plural sheets S received on the processing tray 4; the first holding means 7 for holding and conveying the matched sheet bunch S'; a stapler 8 for stapling the sheet bunch S' held by the first holding means 7; the auxiliary tray 13 positioned above the processing tray 4 and below the preparatory conveying means 5; and, as shown in FIG. 3, the second holding means 10 for receiving and holding the sheet bunch S' held by the first holding means 7 and conveyed to the accumulating tray 9A or 9B and conveying the sheet bunch S' to the predetermined position on the accumulating tray 9A or 9B.

It is assumed that abnormality occurs for some reason while each means is executing a given processing and the entire processing is down. In this case, to set all the means to the initial condition causes a delay in resetting and is not efficient. To solve the problem, by finely dividing the functions of the means into units, each unit can be reset and the unit in process of operation is reset. To reset the unit includes a resetting of software, a resetting of hardware and a resetting of both the software and hardware. For example, as shown in FIG. 17, when the hardware drive sections controlled by some drive sources are controlled by a software module for controlling a software operation, the software module is divided into units to be reset. Furthermore, in general, each operation hardware is controlled by different BIOSs. In this case, by regarding each BIOS as a module unit, each BIOS can be reset. By resetting each unit in this manner, the actual drive section is returned to its initial condition (i.e., an initial processing is performed).

Figure 22:
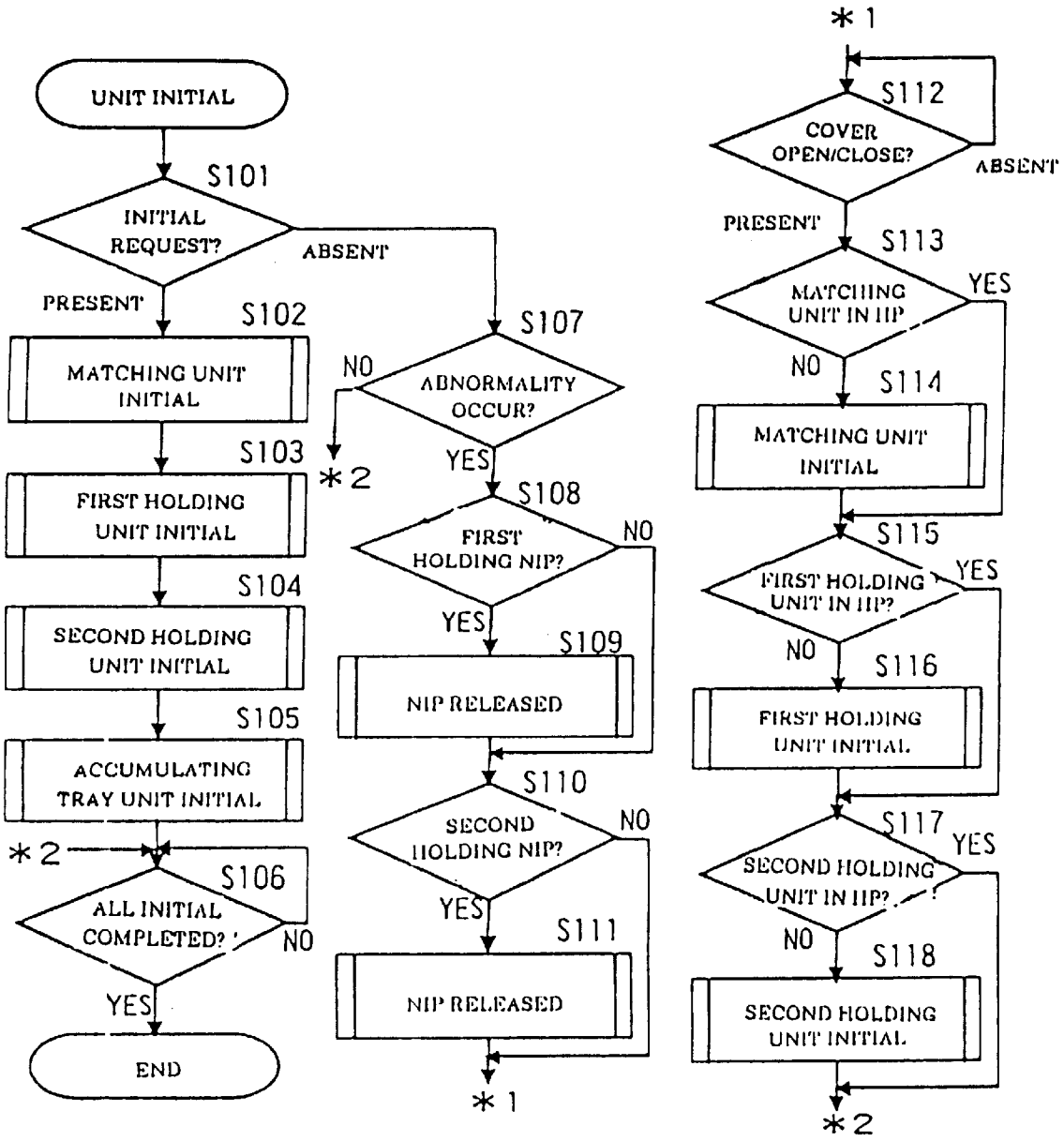
FIG. 22 is a flowchart for dividing into units the process of transferring the sheet bunch from the processing tray to the accumulating tray in the sheet processing device and performing an initial operation of each unit.

FIG. 22 is a flowchart of the initial processing for resetting the unit to the initial condition when the jamming of sheets, the opening of the cover or another trouble occurs in the sheet processing device. In the embodiment, the process of matching by the matching means 6, the process of holding by the first holding means 7, the process of conveying to the accumulating tray 9A or 9B, the process of holding by the second holding means 10 and the process of further conveying to the accumulating tray 9A or 9B are finely divided into module units, so that the drive control of each unit can be reset. Therefore, in FIG. 22, a matching unit means the drive control of matching by the matching means 6, its status flag indicates whether or not the matching means 6 is far from its home position (HP), a first holding unit or a second holding unit means the drive control of conveying by holding of the first holding means 7 or the second holding means 10 and its status flag indicates whether or not the holding means 7 or 10 is far from its home position. Furthermore, an accumulating tray unit means the drive control for moving the accumulating tray 9A or 9B to the position for piling the sheet bunch, and its status flag indicates which tray is to be used as the load-carrying tray. Moreover, in a readable/writable memory (e.g., RAM) in the memory means 121 shown in FIG. 17, a memory space in which the status flag indicating the processing condition of each unit can be stored is allocated. The CPU 120 for controlling reset operation then performs reset operation by initializing the drive control section of each unit while confirming the status flag in the memory space inherent in each unit.

The flowchart of FIG. 22 will be described. When a unit initial processing is started, it is first judged whether or not there is an initial request from the sheet processing device body (S101). The initial process from the sheet processing device body means a forced initial setting, for example, from a user. When the request is present, the initial processing is performed for all the units. Therefore, if it is judged that the initial request is present, the matching means 6, the first holding means 7, the second holding means 10 and the accumulating tray are forced to move to their home positions (S102, S103, S104, S105), and each status flag is returned to its initial setting condition. Subsequently, it is confirmed whether or not all the units are completed (S106). If that is judged to be confirmed, the initial processing is finished.

On the other hand, after it is judged in the process S101 that the initial request is absent, the occurrence of abnormality is confirmed (S107). Subsequently, if it is judged that there is an abnormality, it is first judged whether or not the first holding means 7 is in a holding (nipping) condition (S108). If it is judged that the first holding means 7 is nipping, the nipping is released (S109). Then, if it is judged that the means is not nipping, the process S109 is skipped. Subsequently, it is judged whether or not the second holding means 10 is in the holding (nipping) condition (S110). If it is judged that the second holding means 10 is nipping, the nipping is released (S111). Then, if it is judged that the means is not nipping, the process S111 is skipped. Additionally, the releasing of the nipping by the first and second holding means in the processes S108 to S111 corresponds to the nipping release in the previous initial processing of the first holding unit and the second holding unit (S103, S104). In this manner, plural units of divided functions may further be divided into units of functions for which the initial processing can be performed. As not detailed herein, an instruction can be given to a user to open the cover of the sheet processing device and take out the sheet bunch which has been held by the first or second holding means 7 or 10. After the user opens/closes the cover to take out the sheet bunch, the process goes to step *1, and it is checked whether or not the cover is opened/closed (S112). When the cover is not opened/closed, an instruction is again given to the user to open/close the cover and take out the sheets. Subsequently, when it is judged that the cover is opened/closed, it is judged whether or not the matching unit is in its home position (S113). If not, the drive control of the matching unit is returned to its initial condition (S114). If it is in the home position, it is judged that the unit is not being operated, and the process S114 is skipped. Subsequently, it is judged whether or not the first holding unit is in its home position (S115). If not, the drive control of the first holding unit is returned to its initial condition, i.e., the nipping is released and the first holding unit is returned to its standby condition in the home position (S116). If it is in the home position, it is judged that the unit is not being operated, and the process S116 is skipped. Furthermore, it is judged whether or not the second holding unit is in its home position (S117). If not, the drive control of the second holding unit is returned to its initial condition, i.e., the nipping is released and the second holding unit is returned to its standby condition in the home position (S118). If it is in the home position, it is judged that the unit is not being operated, the process S118 is skipped, and the process is continued to *2.

As aforementioned, the drive control section is divided to functions, and the functions can be separately reset to the initial condition. Thereby, even if trouble occurs, the trouble can be solved more flexibly. Moreover, if there is an initial request from the sheet processing device body, the initial processing of all the units is performed. On the other hand, if there is no initial request, the initial processing of only the unit being operated is performed. Therefore, the initial processing of the other drive sections is unnecessary, and resetting can be performed quickly. Additionally, for the unit requiring no initial processing, the user does not need to confirm the presence of abnormality. Therefore, burdens on the users can be alleviated.

What is claimed is:

1. A method of resetting a sheet processing device which processes sets of sheets conveyed from an image forming device, and includes at least two drive sections and a detecting means for detecting abnormalities in said drive sections, comprising the steps of:

detecting said abnormalities in said at least one drive section and selectively resetting each of said drive sections in which an abnormality has been detected.

2. A method according to claim 1 comprising the further steps:

a) assigning to each of said drive sections a status sensor indicating in a memory means any abnormality status condition of said drive section, and b) resetting each of said drive sections in which said sensor indicates that an abnormality status condition has been detected.

3. A method according to claim 1 comprising the further steps:

a) assigning to each of said drive sections a status sensor indicating in a memory means any abnormality status condition of said drive section, and b) resetting only said drive section for which an abnormality status condition has been detected.

4. A sheet processing device for processing a set sheets conveyed from an image forming device comprising: at least two drive sections, detecting means for detecting an abnormality in any or all of said at least two drive sections, and means selectively resetting any or all of said at least two drive sections when abnormality status conditions are detected.

5. A sheet processing device according to claim 4 further comprising a memory means including a status sensor indicating the abnormality status condition in each of said drive sections.

6. A sheet processing device according to claim 4 further comprising feeding means for conveying the sheets from said image forming device, and wherein each of said drive sections is reset separately from said feeding means.

7. A sheet processing device according to claim 4 further comprising means which resets selectively only those drive sections in which an abnormality is detected.

8. A sheet transfer device for receiving each sheet discharged from an image forming device and discharging each sheet, comprising: at least two drive sections, detecting means for detecting an abnormality of said sheet transfer device, and means selectively resetting said at least two drive sections according to detection of any abnormality by said detecting means.

* * * * *